US007527513B1

(12) United States Patent
Okuyama et al.

(10) Patent No.: US 7,527,513 B1
(45) Date of Patent: May 5, 2009

(54) CONTACT MEMBER DEFORMATION SLOT CONNECTOR

(75) Inventors: Takeshi Okuyama, Shinagawa (JP); Yasushi Masuda, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/166,443

(22) Filed: Jul. 2, 2008

(30) Foreign Application Priority Data

Mar. 7, 2008 (JP) ..... 2008-058124

(51) Int. Cl.
*H01R 11/22* (2006.01)

(52) U.S. Cl. ..... 439/267; 439/259; 439/266

(58) Field of Classification Search ..... 439/266, 439/259, 267, 260, 495
See application file for complete search history.

(56) References Cited

U.S. PATENT DOCUMENTS 3,982,807 A * 9/1976 Anhalt et al. ..... 439/260
4,275,944 A * 6/1981 Sochor ..... 439/267
5,709,562 A * 1/1998 Kourimsky ..... 439/267
6,416,342 B2 * 7/2002 Matsumura ..... 439/267
6,478,596 B2 11/2002 Yoshida
7,004,776 B2 2/2006 Otsu

FOREIGN PATENT DOCUMENTS

JP 54-137663 10/1979
JP 3253602 2/2002
JP 3428906 7/2003

* cited by examiner

*Primary Examiner*—Michael C Zarroli
(74) *Attorney, Agent, or Firm*—IPUSA, PLLC

(57) ABSTRACT

A connector includes an inserting part where a plug connector is inserted, a contact member provided at a side of the inserting part, the contact member being where a basic end part is fixed, and a driving part configured to drive the contact member to a position where the contact member comes in contact with a contacted part of the plug connector inserted in the inserting part.

11 Claims, 26 Drawing Sheets

CONTACT MEMBER DEFORMATION SLOT CONNECTOR

BACKGROUND OF THE INVENTION

1. Field of the Invention

The present invention generally relates to connectors and connecting methods of the connectors. More specifically, the present invention relates to a connector where a contact member is deformed to a plug connector side so that the contact member comes in contact with a non-contact part of the plug connector, and a connecting method of the connector.

2. Description of the Related Art

For example, plural connectors are provided in an inspection apparatus configured to inspect electric characteristics of a board where a semiconductor device is mounted, in order to improve inspection efficiency. A large number such as several tens or several hundreds of the boards are provided to the connectors. In addition, plug connectors of the large number of chucked boards are inserted into inserting parts of the connectors so that inspection is performed when a contact member comes in contact with a contacted part of the plug connector.

In such an inspection apparatus which electrically inspects when the contact member comes in contact with the contacted part of the plug connector, it is important to achieve contact reliability of the contact member contacting the contacted part of the plug connector.

In addition, after inspection is completed, the plug connectors of the large number of the boards are taken out from the connectors. In the connector where a large number of the plug connectors are repeatedly inserted and taken out, a driving mechanism is applied in order to reduce abrasion or wear of the contact members. The driving mechanism is configured to press the contact member to the contacted part of the plug connector by a spring force at the time of inspection and separate the contact member from the plug connector at the time when the plug connector is taken out.

For example, connectors having the following structures have been suggested.

In a first example, contact members provided at both sides of an inserting part where a plug connector is inserted are situated in positions separated by a length greater than the thickness of the plug connector. After the plug connector is inserted in the inserting part, the contact members are deformed to a plug connector side by operations of a cam mechanism so that the contact members come in contact with the plug connector by sandwiching the plug connector with the contact members. See, for example, Japanese Patent No. 3,428,906, Japanese Patent No. 3,253,602, and U.S. Pat. No. 6,478,596.

In a second example, after a plug connector is inserted, contact members are deformed to a plug connector side by going down a slide member so that the plug connector is sandwiched from both sides by the contact members. See, for example, Japanese Laid-Open Patent Application Publication No. 54-137663.

In a third example, a plate spring horizontally provided on a bottom of an inserting part is curved. The plate spring is pressed by a head end part of the plug connector so as to be curved in a pressing direction. As a result of this, the contact member is deformed to a plug connector side and the contact member is sandwiched. See, for example, U.S. Pat. No. 7,004,776.

In the connector, there is a general tendency in recent years that the number of contact cores is increasing and gap pitches between the contact members are becoming narrow. In addition, there is a demand for miniaturization of the members and securing a contact pressure of the contact member.

However, in the connectors described in Japanese Patent No. 3,428,906, Japanese Patent No. 3,253,602, and U.S. Pat. No. 6,478,596, since the contact part of the contact member is deformed by operations of the cam mechanism, if the cam mechanism is miniaturized, the amount of deformation of the contact part of the contact member becomes small so that the contact pressure may be decreased. If the amount of deformation of the contact member becomes large in order to secure the contact pressure of the contact member, the size of the cam mechanism becomes large so that miniaturization of the cam mechanism cannot be achieved.

In addition, in the connectors described in Japanese Laid-Open Patent Application Publication No. 54-137663 and U.S. Pat. No. 7,004,776, if the plate spring is made miniaturized, the amount of deformation of the contact member becomes small so that the contact pressure may be decreased. If the contact pressure of the contact member is attempted to be secured, a receiving space of the plate spring becomes large so that it is difficult to achieve miniaturization.

SUMMARY OF THE INVENTION

Accordingly, embodiments of the present invention may provide a novel and useful connector and a connecting method of the connector solving one or more of the problems discussed above.

One aspect of the present invention may be to provide a connector, including:

an inserting part where a plug connector is inserted;

a contact member provided at a side of the inserting part, the contact member being where a basic end part is fixed; and a driving part configured to drive the contact member to a position where the contact member comes in contact with a contacted part of the plug connector inserted in the inserting part;

wherein a contact part is formed between a head end part and the basic end part of the contact member, the contact part contacting the contacted part of the plug connector;

the driving part includes a driving member configured to press the head end part of the contact member to the plug connector side;

the driving member is deformed so that the contact part of the contact member comes in contact with the contacted part of the plug connector; and the driving member deforms the head end part of the contact member to the plug connector side so that the head end part of the contact member comes in contact with the plug connector.

The contact member may be provided so that the head end part can be deformed to the plug connector side; and the contact part may be curved so that a top of the curve is closest to the plug connector.

A connector holding member may be formed at a head end part of the contact member; the driving member may include a cam part configured to deform the head end part to the plug connector side; and by operations of the cam part, the contact part of the contact member may come in contact with the contacted part of the plug connector, and the contact holding member comes in contact with the plug connector.

The connector holding member may hold the head end parts of plural contact members and is made of an insulation material.

An elastic member may be provided between the driving member and the contact holding member; and after the contact holding member may come in contact with the plug connector due to deformation of the driving member, the elastic member is elastically deformed.

A pair of the connector holding members may be provided, and one of the connector holding members is provided at one side of the inserting part and another of the connector holding members is provided at another side of the inserting part; the one of the connector holding members may hold a head end part of the contact member provided at the one side of the inserting part; and the other of the connector holding members may hold a head end part of the contact member provided at the other side of the inserting part.

The connector holding member may include a stopper part configured to come in contact with the plug connector; and the cam part of the driving member may deform the connector holding member to the plug connector side and deforms the stopper part so that the stopper part comes in contact with the plug connector.

The driving member may be provided outside a pair of the connector holding member; and the driving member may perform sliding operations along a side surface of the plug connector so that the pair of the connector holding members is deformed to the plug connector side.

The driving member may deform the pair of the connector holding members to the plug connector side by a rotational operation.

Another aspect of the present invention may be to provide a connecting method of a connector, the connector including an inserting part where a plug connector is inserted;

a contact member provided at a side of the inserting part, the contact member being where a basic end part is fixed; and a driving part configured to drive the contact member to a position where the contact member comes in contact with a contacted part of the plug connector inserted in the inserting part;

the connecting method of the connector including the steps of:

causing a contact part of the contact member to contact a contacted part of the plug connector by pressing a head end part of the contact member to a side of the plug connector inserted in the inserting part by a driving member of the driving part;

causing a head end part of the contact member to contact the plug connector by the driving of the driving member; and elastically deforming the elastic member due to deformation of the driving member when the head end part of the contact member comes in contact with the plug connector.

Another aspect of the present invention may be to provide a connecting method of a connector, the connector including an inserting part where a plug connector is inserted;

a contact member provided at a side of the inserting part, the contact member being where a basic end part is fixed; and a driving part configured to drive the contact member to a position where the contact member comes in contact with a contacted part of the plug connector inserted in the inserting part;

the connecting method of the connector including the steps of:

causing a contact part of the contact member to contact a contacted part of the plug connector by pressing a connector holding member provided at a head end part of the contact member to a side of the plug connector inserted in the inserting part by a driving member of the driving part;

causing the connector holding member contact to the plug connector based on pressing, by the driving member, the head end part of the contact member to the side of the plug connector; and elastically deforming the elastic member due to deformation of the driving member when the contact holding member comes in contact with the plug connector.

According to embodiments of the present invention, the head end part of the contact member is pressed to the plug connector side so that the contact part of the contact member comes in contact with the contacted part of the plug connector. The head end part of the contact member comes in contact with the plug connector so that the contact pressure of the contact member is stably secured and it is possible to correspond to the narrow pitch and miniaturization of the contact member.

Other objects, features, and advantages of the present invention will become more apparent from the following detailed description when read in conjunction with the accompanying drawings.

DETAILED DESCRIPTION OF THE PREFERRED EMBODIMENTS

A description is given below, with reference to the FIG. 1A through FIG. 15B of embodiments of the present invention.

First Embodiment

Figure 1A:
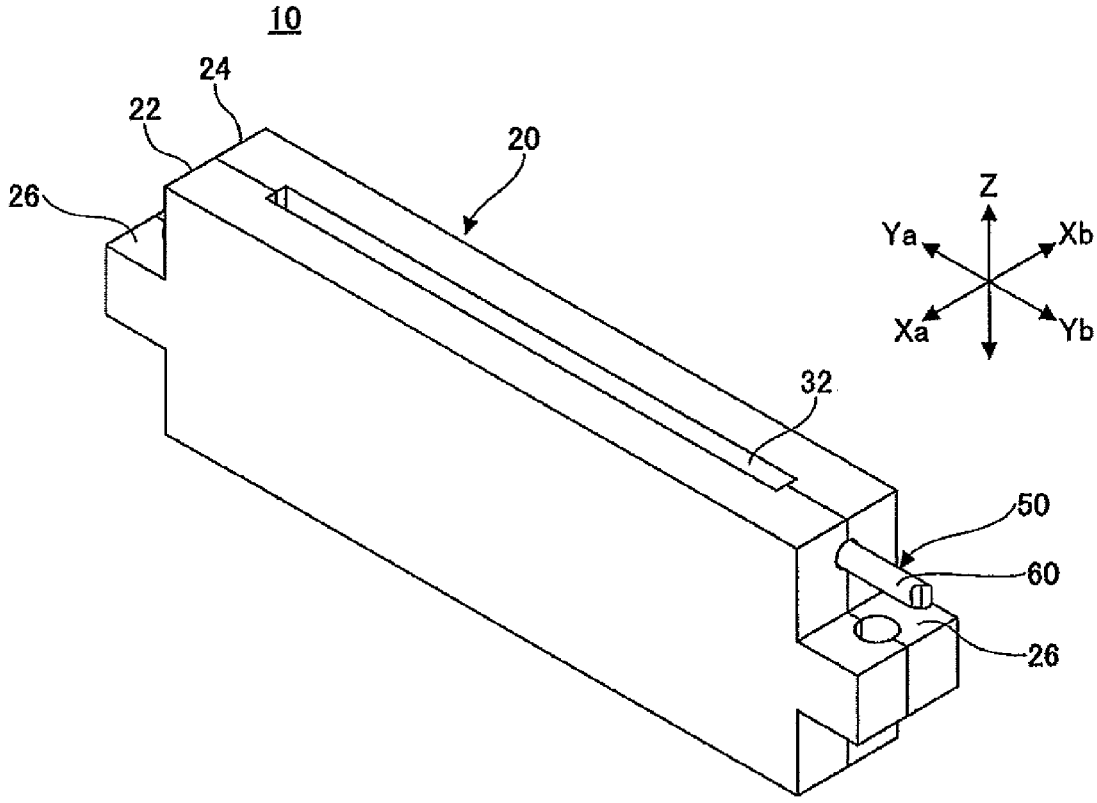
FIG. 1A is a perspective view of a connector of a first embodiment of the present invention.
Figure 1B:
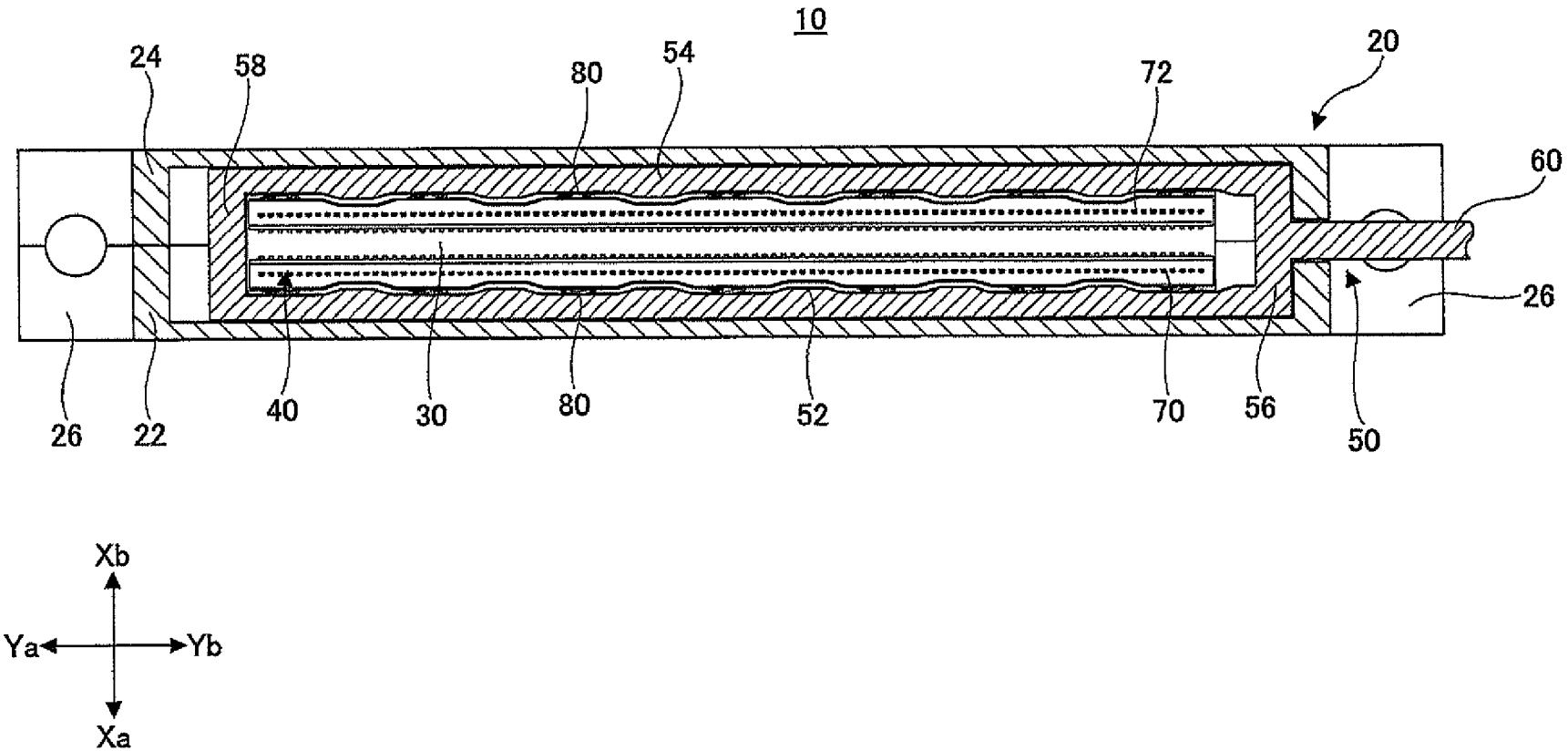
FIG. 1B is a plan cross-sectional view of the connector shown in FIG. 1A.
Figure 2:
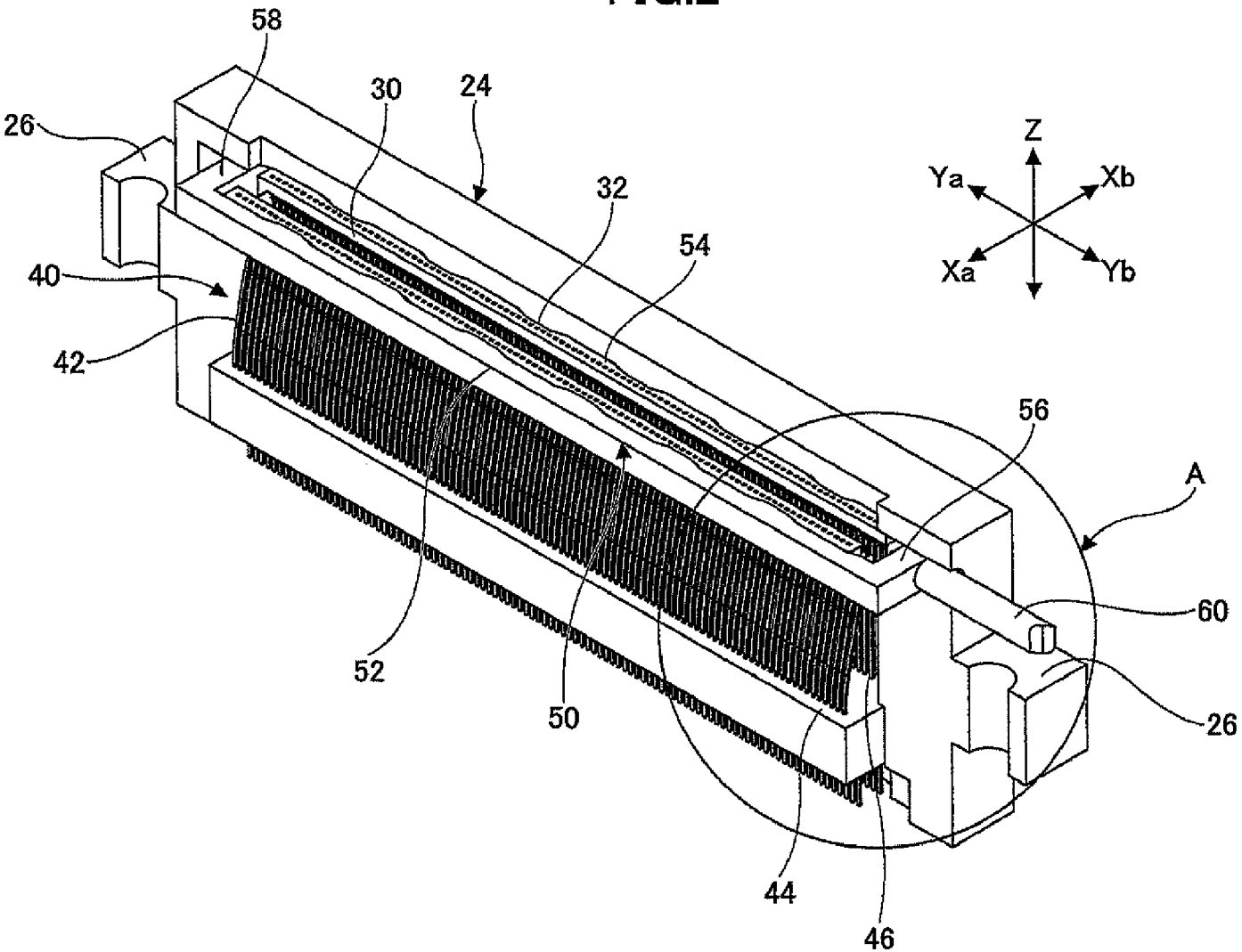
FIG. 2 is a perspective view of the connector where a cover member is removed.

FIG. 1A is a perspective view of a connector 10 of a first embodiment of the present invention. FIG. 1B is a horizontal cross-sectional view of the connector 10 shown in FIG. 1A. FIG. 2 is a perspective view of the connector 10 where a cover member 22 has been removed.

As shown in FIG. 1A, FIG. 1B, and FIG. 2, the connector 10 is provided in an inspection apparatus configured to inspect electric characteristics of a board where a semiconductor device is mounted. The connector 10 includes a housing 20, an inserting part 30, a contact part 40, and a driving part 50. A plug connector 90 of the board (not shown) is to be inserted in the housing 20. The inserting part 30 is formed inside the housing 20. The contact part 40 is provided at both sides of the inserting part 30. The driving part 50 is configured to drive the contact part 40.

The housing 20 is formed by attaching a pair of cover members 22 and 24 which are formed by dividing the housing 20 in an X-direction. Fixing parts 26 project from both ends in a Y-direction of the housing 20. The projection parts 26 are fixed to, for example, an attaching surface of the inspection apparatus configured to inspect the electric characteristics of the board where the semiconductor device is mounted.

The inserting part 30 is a space formed inside the housing 20. The inserting part 30 is formed in a longitudinal direction (Y-direction) of the housing 20. In addition, the inserting part 30 communicates with an opening part 32 formed in an upper surface of the housing 20. The opening part 32 is formed on a center line of the inserting part 30. The opening part 32 has dimensions slightly greater than the width (dimension in the Y-direction) and the thickness (dimension in the X-direction) of the plug connector so that the plug connector can enter the opening part 32.

Figure 3:
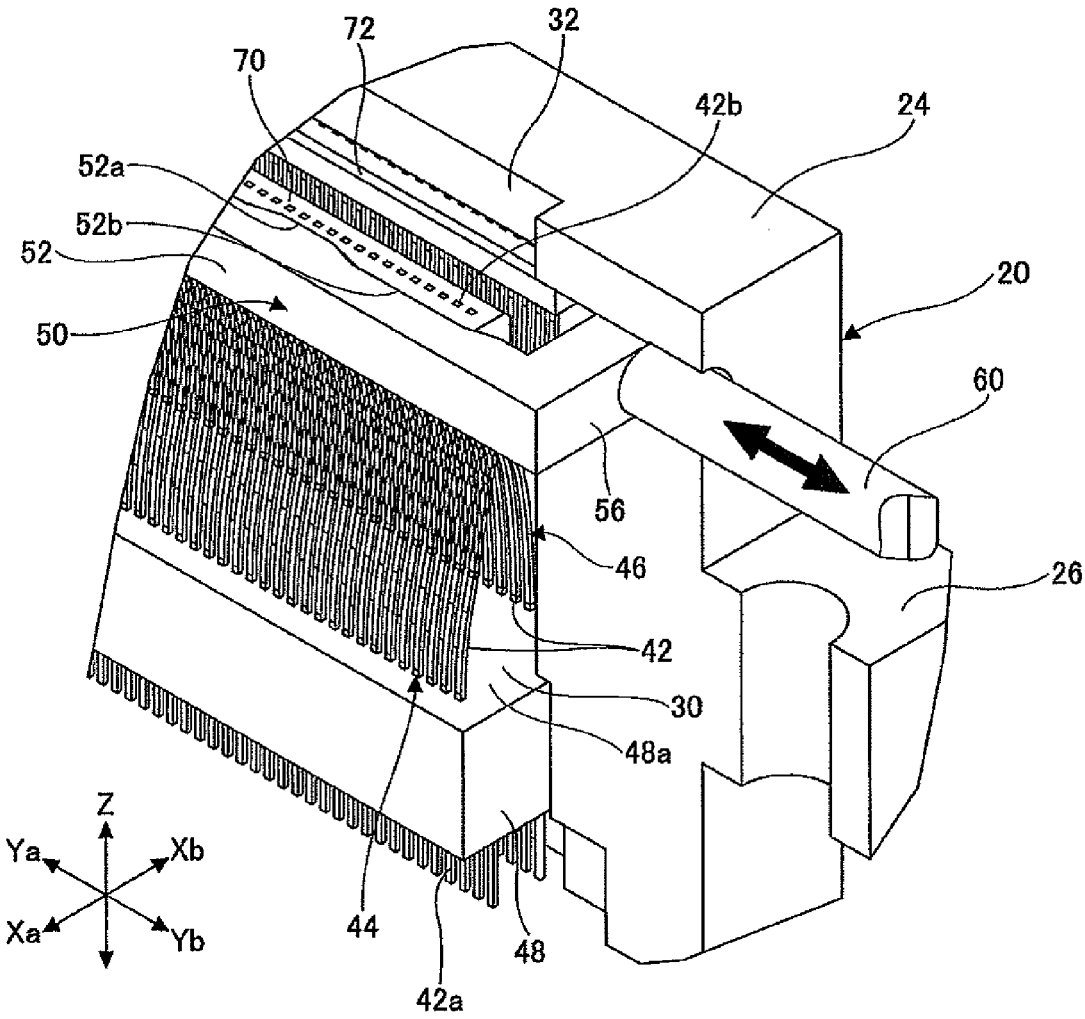
FIG. 3 is an expanded perspective view of a portion A shown in FIG. 2.
Figure 4:
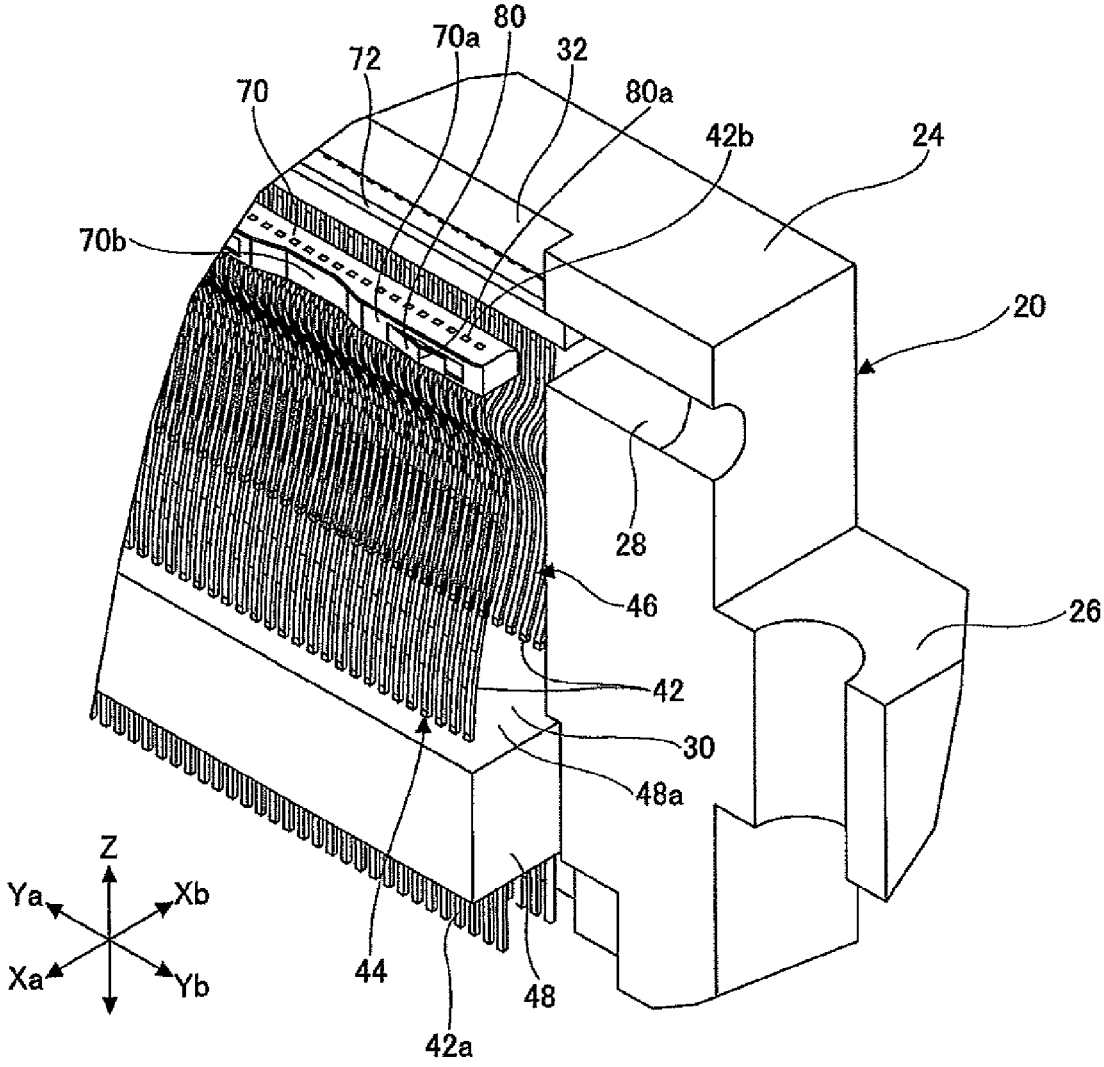
FIG. 4 is a perspective view of a portion A shown in FIG. 2 where a driving part 50 is removed.

FIG. 3 is an expanded perspective view of a portion A shown in FIG. 2. FIG. 4 is a perspective view of the portion A shown in FIG. 2 where the driving part 50 is removed.

As shown in FIG. 3 and FIG. 4, the contact part 40 includes a first contact member line 44 and a second contact member line 46. The first contact member line 44 and the second contact member line 46 are formed by arranging a large number of contact members 42. The contact members 42 are made of a conductive metal material. The first contact member line 44 is provided at an Xa side of the inserting part 30. The second contact member lone 46 is provided at an Xb side of the inserting part 30. The first contact member line 44 and the second contact member line 46 are formed in a symmetrical manner seen in the Y-direction. The first contact member line 44 and the second contact member line 46 are supported where basic end parts 42*a* situated at lower sides of the contact members 42 pierce a basic end holding member 48 made of an insulation resin material.

While a structure where the first contact member line 44 and the second contact member line 46 are provided at both sides of the inserting part 30 in a symmetrical manner is discussed in this example, the present invention can be applied to a structure where the contact members 42 are provided at a single side of the inserting part 30.

The basic end part holding part 48 is fixed inside the housing 30. An upper surface 48*a* is a contact surface where an inserting end part 90*a* (see FIG. VA) of the plug connector 90 comes in contact to set the inserting depth. Because of this, the upper surface 48*a* of the basic end holding member 48 is a fulcrum of operations in the X-direction of each contact member 42.

The driving part 50 includes a first driving member 52 and a second driving member 54. The first driving member 52 extends in the Y-direction outside the first contact member line 44. The second driving member 54 extends in the Y-direction outside the second contact member line 46. The first driving member 52 and the second driving member 54 are supported slidably in the Y-direction along the plug connector 90 side surface and corresponding ends of the first driving member 52 and the second driving member 54 are connected to each other in a body by connecting parts 56 and 58.

A driving shaft 60 extending from the connecting part 56 in the Y-direction pierces a side surface of the housing 20 and is connected to a driving part provided outside the housing 20. The driving part is, for example, an actuator such as a motor or a solenoid. The driving part is configured to transfer a driving force in the Y-direction to the driving shaft 60 and slide the entire driving part 50 in a Ya-direction or a Yb-direction.

Next, a structure of the driving part 50 and operations for deforming the contact member 42 from a non-contact position to a contact position are discussed with reference to FIG. 5 and FIG. 6 in addition to FIG. 1 through FIG. 4.

Figure 5:
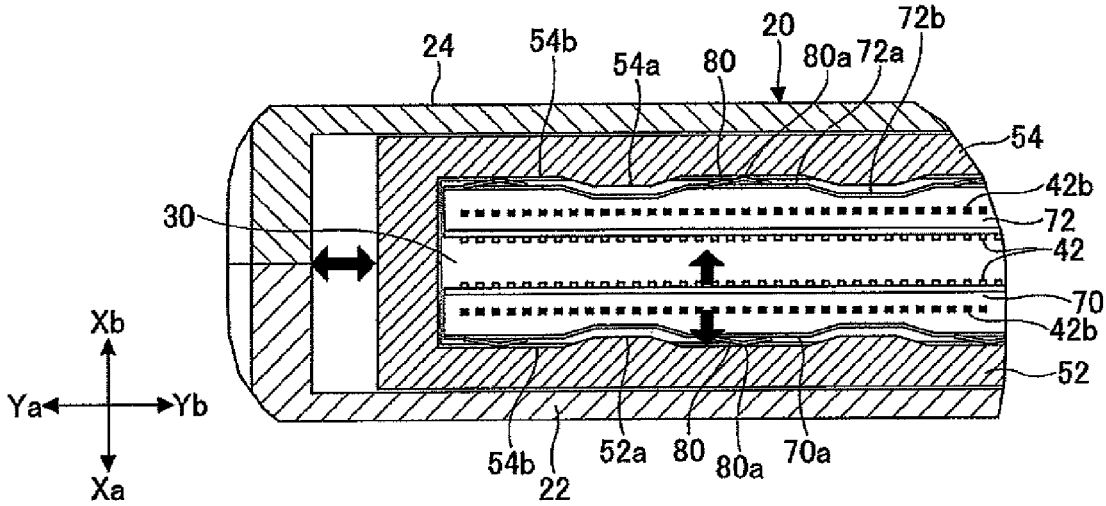
FIG. 5 is a plan view showing, in an expanded manner, a structure of the driving part 50 and a contact member 42 situated in a non-contact position.

FIG. 5 is a plan view showing, in an expanded manner, a structure of the driving part 50 and the contact member 42 situated in a non-contact position. FIG. 6 is a plan view showing, in an expanded manner, the structure of the driving part 50 and an operating state whereby the contact member 42 is driven so as to be situated in a contact position.

As shown in FIG. 3 and FIG. 5, a first contact holding member 70 is formed by molding in head end parts 42*b* which are upper ends of the contact members 42 of the first contact member line 44. The first contact holding member 70 is made of an insulation resin material. The first contact holding member 70 provided at the Xa side of the inserting part 30 is held where the head end parts 42*b* of the contact members 42 of the first contact member line 44 are inserted in the first contact holding member 70. The first contact holding member 70 is provided so as to connect the head end parts 42*b* of the contact members 42.

In addition, a second contact holding member 72 is formed by molding in head end parts 42*b* which are upper ends of the contact members 42 of the second contact member line 46. The second contact holding member 72 is made of an insulation resin material. The second contact holding member 72 provided at the Xb side of the inserting part 30 is held where the head end parts 42*b* of the contact members 42 of the second contact member line 46 are inserted in the second contact holding member 72. The second contact holding member 72 is provided so as to connect the head end parts 42*b* of the contact members 42.

Thus, the first contact holding member 70 and the second contact holding member 72 are provided at the Xa direction side and the Xb direction side, respectively, of the inserting part 30 and situated in parallel in the Y direction.

The connecting parts 56 and 58 of the driving part 50 are on step plane surfaces 28 formed inside the housing 20. The connecting parts 56 and 58 are supported, by the step plane surface 28, slidable only in a sliding direction (Y-direction). A space where the driving members 52 and 54 move in the Y-direction is formed inside the housing 20. In addition, the driving members 52 and 54 come in contact with internal walls of the cover members 22 and 24 so that movement of the driving members 52 and 54 in the X-direction is limited.

As shown in FIG. 4 and FIG. 5, plural elastic members 80 are provided on external side surfaces of the first contact holding member 70 and the second contact holding member 72 with designated gaps. The elastic members 80 are plate springs extending in the Y-direction. The elastic member 80 is bent with an angle so that a top part 80*a* is formed at an intermediate part in the Y-direction of the elastic member 80.

The top part 80*a* projects to a side part of the first contact holding member 70 or the second contact holding member 72 so as to come in contact with the driving member 52 or 54, respectively. One end of the elastic member 80 is fixed to the side surface of the first contact holding member 70 or the second contact holding member 72. Another end of the elastic member 80 is a free end which can be slid in the Y-direction.

The elastic member 80 has a spring force stronger than that of each contact member 42. Accordingly, when the elastic member 80 is pressed by the driving member 52 or 54, the elastic member 80 is deformed with the contact holding member 70 or 72 in a pressing direction (Xa direction or Xb direction).

When the contact holding member 70 or 72 comes in contact with the plug connector 90, the top part 80*a* of the elastic member 80 is pressed and deformed. As a result of this, a spring force is applied to the contact member 42 and thereby a contact pressure applied to the plug connector 90 can be secured.

An attaching surface 70*a* or 72*a* and a trapezoidal-shaped concave part 70*b* or 72*b* are mutually formed on an external side surface of the contact holding member 70 or 72 in a longitudinal direction (Y-direction). The elastic member 80 is attached to the attaching surface 70*a* or 72*a*. The trapezoidal-shaped concave part 70*b* or 72*b* is sunken inside from the attaching surface 70*a* or 72*a*.

A trapezoidal-shaped cam part 52*a* or 54*a* and an escape part 52*b* or 54*b* are mutually formed on an internal side surface of the driving member 52 or 54 in the Y-direction. The trapezoidal-shaped cam part 52*a* or 54*a* corresponds to the trapezoidal-shaped concave part 70*b* or 72*b* of the contact holding member 70 or 72. The escape part 52*b* or 54*b* is sunken outside away from the cam part 52*a* or 54*a*.

As shown in FIG. 1B and FIG. 5, in a non-contact state where the plug connector can be inserted or detached, the cam part 52*a* or 54*a* of the driving member 52 or 54 is positioned so as to face the trapezoidal-shaped concave part 70*b* or 72*b* of the contact holding member 70 or 72. The escape part 52*b* or 54*b* of the driving member 52 or 54 faces the attaching surface 70*a* or 72*a* of the elastic member 80.

In this non-contact state, the contact holding member 70 or 72 configured to hold the head end part 42*b* of each contact member 42 is in a non-contact position (a position separated from the plug connector 90) by an applying force of a lower part of each contact member 42. At this time, because the elastic member 80 faces the escape part 52*b* or 54*b* of the driving member 52 or 54, the elastic member 80 is not pressed.

Here, a connection where the plug connector 90 is inserted in the inserting part 30 is discussed with reference to FIG. 6.

Figure 6:
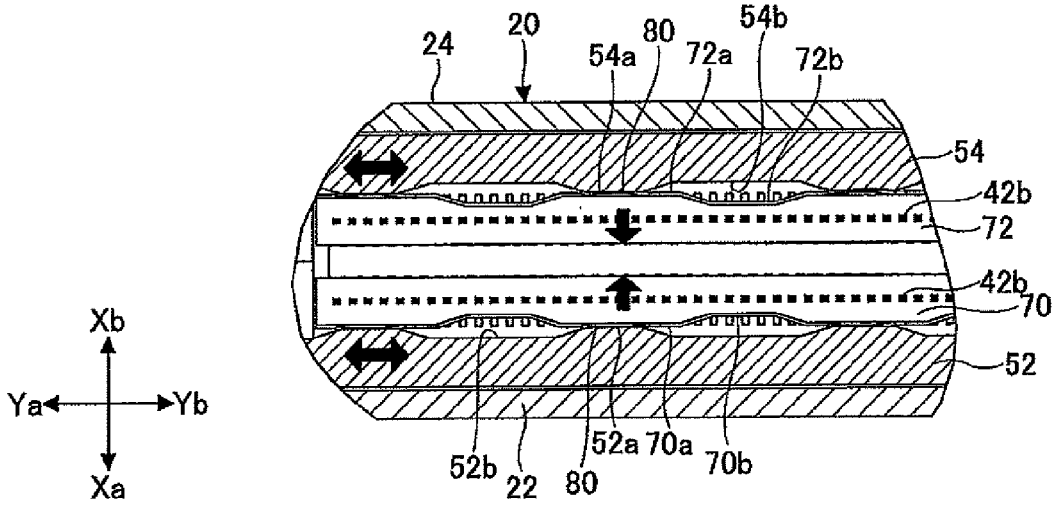
FIG. 6 is a plan view showing, in an expanded manner, the structure of the driving part 50 and an operating state whereby the contact member 42 is driven so as to be situated in a contact position.

FIG. 6 is a plan view showing, in an expanded manner, the structure of the driving part 50 and an operating state whereby the contact member 42 is driven so as to be situated in a contact position. In FIG. 6 the inserting part 30 is shown in a position for the plug connector 90 to be inserted but illustration of the plug connector 90 is omitted.

When the plug connector 90 is inserted in the inserting part 30, the driving part 50 is driven in the Ya-direction. Thus, when the driving part 50 performs sliding operations, the cam part 52*a* or 54*a* of the driving member 52 or 54 moves from a position facing the trapezoidal-shaped concave part 70*b* or 72*b* to a position facing the attaching surface 70*a* or 72*a* so as to press the elastic member 80 to the inserting part 30 side.

The cam part 52*a* or 54*a* is formed in a trapezoidal shape. While an inclination part of the cam part 52*a* or 54*a* slides and contacts the top part 80*a* of the elastic member 80, the cam part 52*a* or 54*a* presses the elastic member 80 in the X-direction.

Thus, a force for moving the cam part 52*a* or 54*a* of the driving member 52 or 54 in the Y-direction is transferred to the contact holding member 70 or 72 via the elastic member 80 so as to become a driving force for deforming the head end part 42*b* of the each contact member 42 toward the plug connector 90 inserted in the inserting part 30.

Here, an internal structure of the connector 10 is discussed with reference to FIG. 7A and FIG. 7B.

Figure 7A:
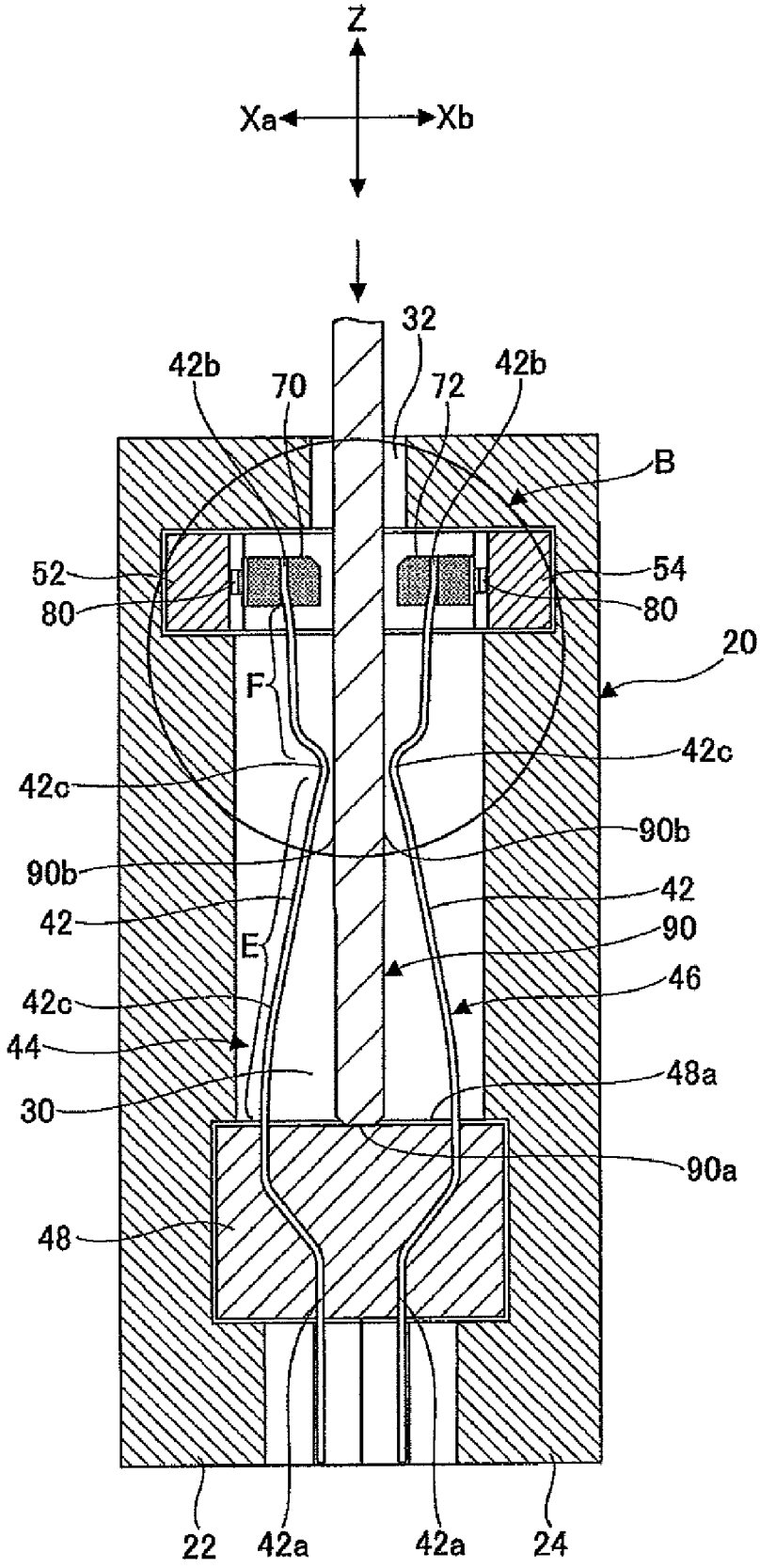
FIG. 7A is a vertical cross-sectional view showing the contact member 42 situated in the contact position.

FIG. 7A is a vertical cross-sectional view showing the contact member 42 situated in the contact position. FIG. 7B is an expanded vertical cross-sectional view showing a portion B shown in FIG. 7A.

Figure 7B:
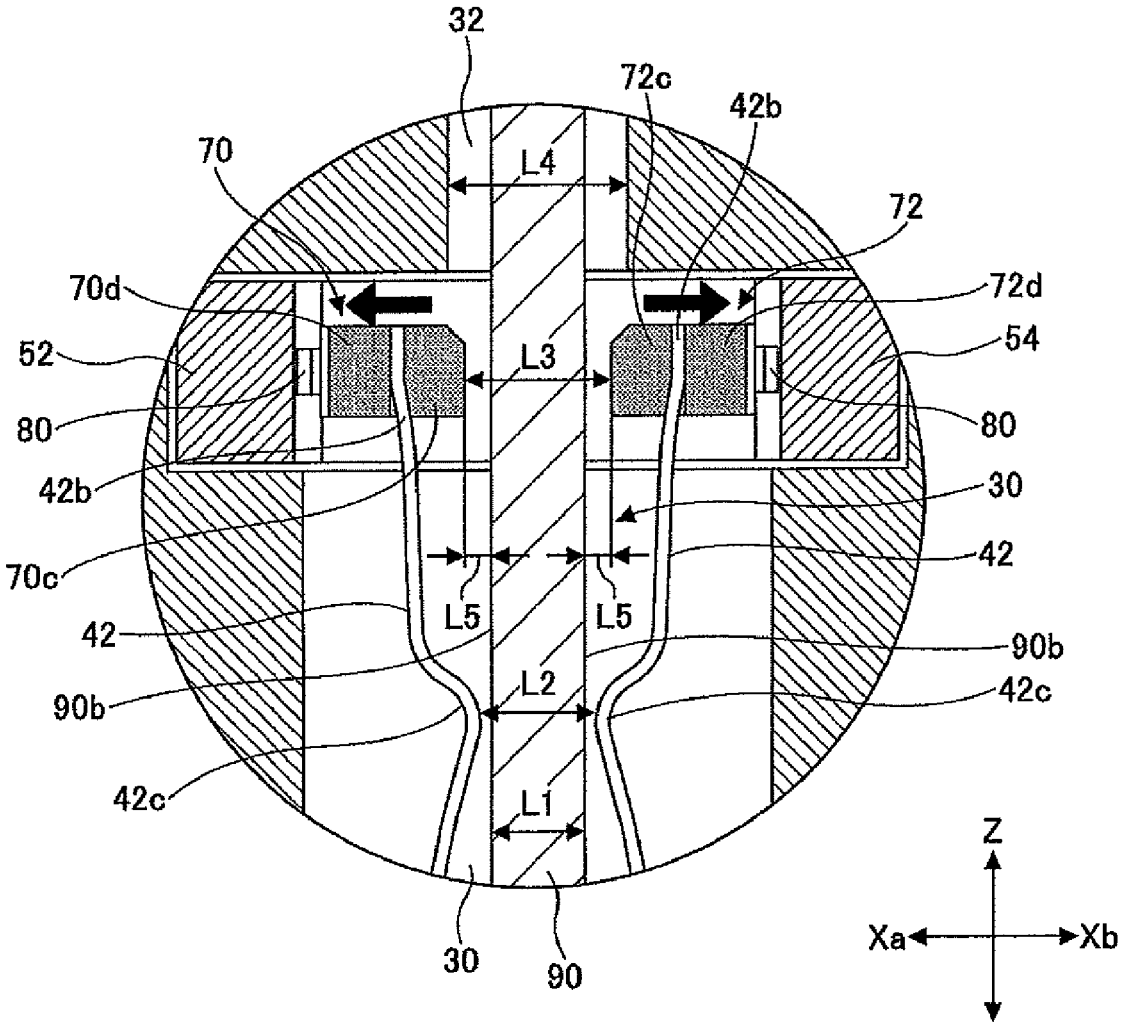
FIG. 7B is an expanded vertical cross-sectional view showing a portion B shown in FIG. 7A.

As shown in FIG. 7A and FIG. 7B, each contact member 42 of the contact member line 44 or 46 is held where the basic end part 42*a* is inserted in the basic end holding member 48 fixed to a bottom part of the inserting part 30. The head end part 42*b* is inserted in the contact holding member 70 or 72. Two parts of the basic end part 42*a* of each contact member 42 are bent inside the basic end part holding member 48 so that the basic end part 42*a* has an S-shaped configuration. A spring force is applied in a direction where the head end part 42*b* is opened outside. Because of this, the head end parts 42*b* of the contact members 42 of the contact member lines 44 and 46 provided at both sides (Xa and Xb directions) of the inserting part 30 are urged in a direction separated from each other.

In each contact member 42, a contact part 42*c* is formed between the basic end part 42*a* and the head end part 42*b*. The contact part 42*c* is curved inside. The contact members 42 of the contact member lines 44 and 46 are provided in a symmetrical manner with respect to a center line of the housing 20 so that the contact parts 42*c* are closest to each other.

Each contact member 42 obtains the contact pressure formed with a spring force due to elastic deformation of a lower part E with the contact part 42*c* and a spring force due to elastic deformation of an upper part F. Accordingly, it is possible to make the amount of deformation of the contact part 42*c* small. Because of this, it is possible to make a receiving space of each contact member 42 at both sides of the inserting part 30 small so that the housing 20 can be miniaturized.

In the contact holding member 70 or 72 connecting the head end part 42*b* of the contact member 42, an inside part (inserting part 30 side) is a stopper part 70*c* or 72*c* configured to come in contact with the plug connector 90. An outside part (driving member 52 or 54 side) is a pressed part 70*d* or 72*d* having the attaching surface 70*a* or 72*a* of the elastic member 80.

When the plug connector 90 is inserted or detached, the elastic member 80 is not pressed by the cam parts 52*a* and 54*a* of the driving members 52 and 54. Therefore, a separating length L2 between the contact parts 42*c* when the plug connector 90 is inserted or detached is slightly longer than the thickness L1 of the plug connector 90 (L2>L1, See FIG. 7B).

In addition, a separating length L3 between the stopper parts 70*c* and 72*c* is greater than the separating length L2 of the contact parts 42*x* and shorter than the width L4 in the X-direction of the opening part 32 (L4>L3>L2, See FIG. 7B).

When the plug connector 90 is inserted from the opening part 32 of the housing 20 into the inserting part 30, an inserting side end part (lower end) of the plug connector 90 enters between the stopper parts 70*c* and 72*c*. Because of this, if the plug connector 90 is inserted along the center line of the inserting part 30, the plug connector is inserted without contacting the stopper parts 70*c* and 72*c*.

However, if the plug connector 90 is shifted in the Xa or Xb direction with respect to the inserting part 30, the plug connector 90 comes in contact with the stopper parts 70*c* and 72*c* positioned in a direction where the inserting side end part of the plug connector 90 is shifted. Because of this, while the inserting side end part 90*a* of the plug connector 90 is inserted in the inserting part 30, the contact part 42*c* is shifted in the X direction so that the inserting side end part 90*a* is prevented from coming in contact with the contact part 42*c*.

A deformation length L5 in the Xa or Xb direction due to sliding operations of the cam part 52*a* or 54*a* is longer than (L3−L1)/2, where the separating length between the stopper parts 70*c* and 72*c* is defined as L3 and the thickness of the plug connector is defined as L1 ((L3−L1)/2<L5, (see FIG. 7B).

Next, operations of the stopper parts 70*c* and 72*c* for sandwiching both sides of the plug connector 90 are discussed with reference to FIG. 5A and FIG. 8B.

Figure 8A:
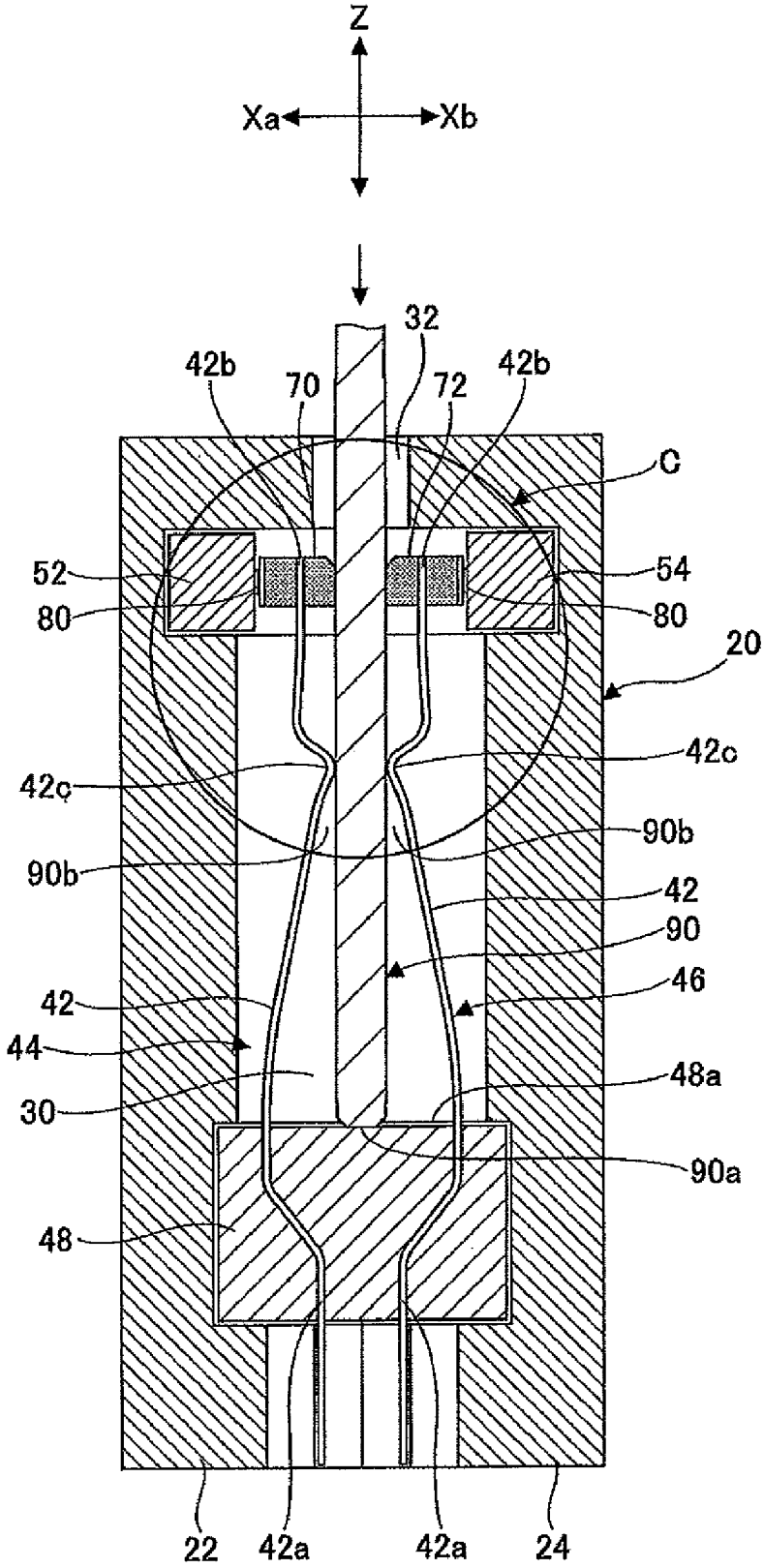
FIG. 8A is a vertical cross-sectional view showing an operating state whereby the contact member 42 is driven so as to situated in the non-contact position.

Here, FIG. 8A is a vertical cross-sectional view showing an operating state whereby the contact member 42 is driven so as to be situated in the non-contact position. FIG. 8B is an expanded vertical cross-sectional view showing a portion C shown in FIG. 8A.

Figure 8B:
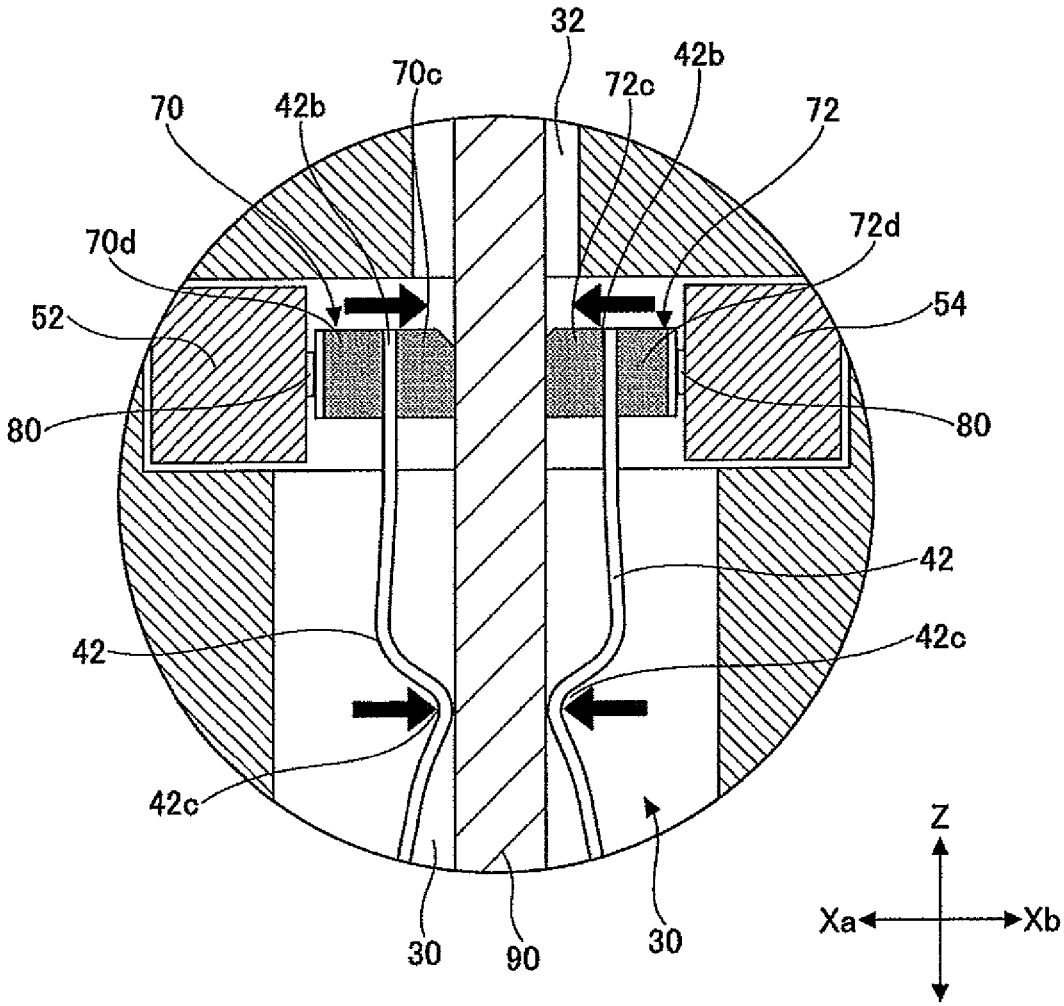
FIG. 8B is an expanded vertical cross-sectional view showing a portion C shown in FIG. 8A.

As shown in FIG. 8A and FIG. 8B, when the driving members 52 and 54 are slid in the Ya-direction so that the cam parts 52*a* and 54*a* press the elastic member 80, the contact holding members 70 and 72 are pressed via the elastic member 80 so as to be close to each other.

As a result of this, each contact member 42 held by the contact holding member 70 or 72 is deformed in the Xb or Xa direction, so that the contact parts 42*c* formed in the intermediate part of the contact member 42 come in contact with the contacted part 90*b* formed on both sides of the plug connector 90.

In addition, when the contact holding members 70 and 72 are pressed in the Xb and Xa direction by sliding operations of the cam part 52*a* and 54*a*, the stopper part 70*c* and 72*c* come in contact with the plug connector 90. By contacting operations of the stopper parts 70*c* and 72*c*, the head end parts 42*b* of the contact member 42 are pressed in the Xb and Xa directions so that the plug connector 90 is sandwiched.

Furthermore, when the head end parts 42*b* of the contact member 42 are deformed in the Xb and Xa direction, a spring force of an upper part F is applied as a pressing force in the Xb and Xa directions to the contact part 42*c*. Hence, a contact pressure of the contact part 42*c* to the plug connector 90 becomes a designated contact pressure required for inspection. In other words, the contact pressure of the contact part 42*c* to the contacted part 90*b* of the plug connector 90 is determined by a length (L3−L1) where the stopper parts 70*c* and 72*c* come in contact with the plug connector 90 and a length between the contact part 42*c* and the head end part 42*b*. A spring force of the contact member 42 which elastically deforms becomes constant so that a stable contact pressure can be obtained.

In addition, the driving members 52 and 54 having the cam parts 52*a* and 54*a* are slid in the Ya direction. As a result of this, the elastic member 80 presses the contact holding members 70 and 72 in the X-direction so that the contact holding members 70 and 72 are close to each other. Hence, it is possible to make the amount of deformation in the X-direction small and correspond to miniaturization.

Here, connecting operations are further discussed with reference to FIG. 9A through FIG. 9C.

Figure 9A:
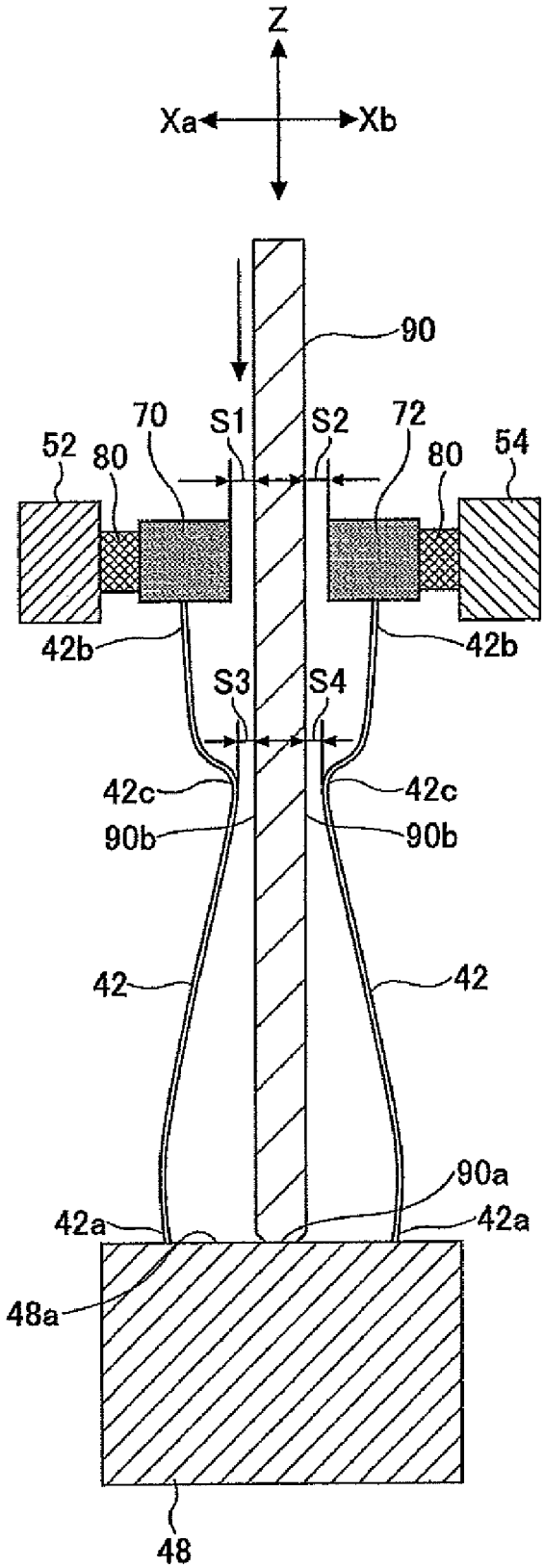
FIG. 9A is a vertical cross-sectional view for explaining a first step in a case where a plug connector 90 is inserted into the center of an insertion part 30.

FIG. 9A is a vertical cross-sectional view for explaining a first step in a case where a plug connector 90 is inserted into the center of an insertion part 30. FIG. 9B is a vertical cross-sectional view for explaining a second step in a case where the plug connector 90 is inserted into the center of the insertion part 30. FIG. 9C is a vertical cross-sectional view for explaining a third step in a case where the plug connector 90 is inserted into the center of the insertion part 30.

Figure 9B:
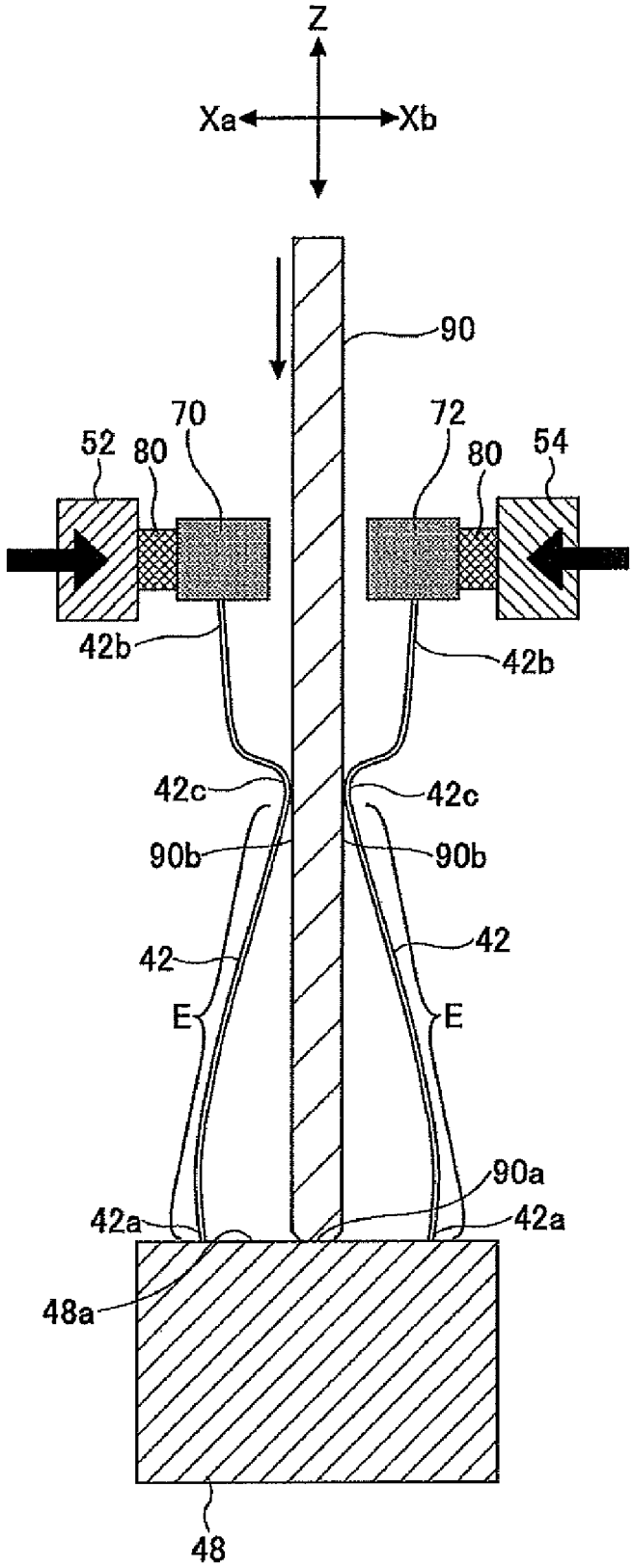
FIG. 9B is a vertical cross-sectional view for explaining a second step in a case where the plug connector 90 is inserted into the center of the insertion part 30.
Figure 9C:
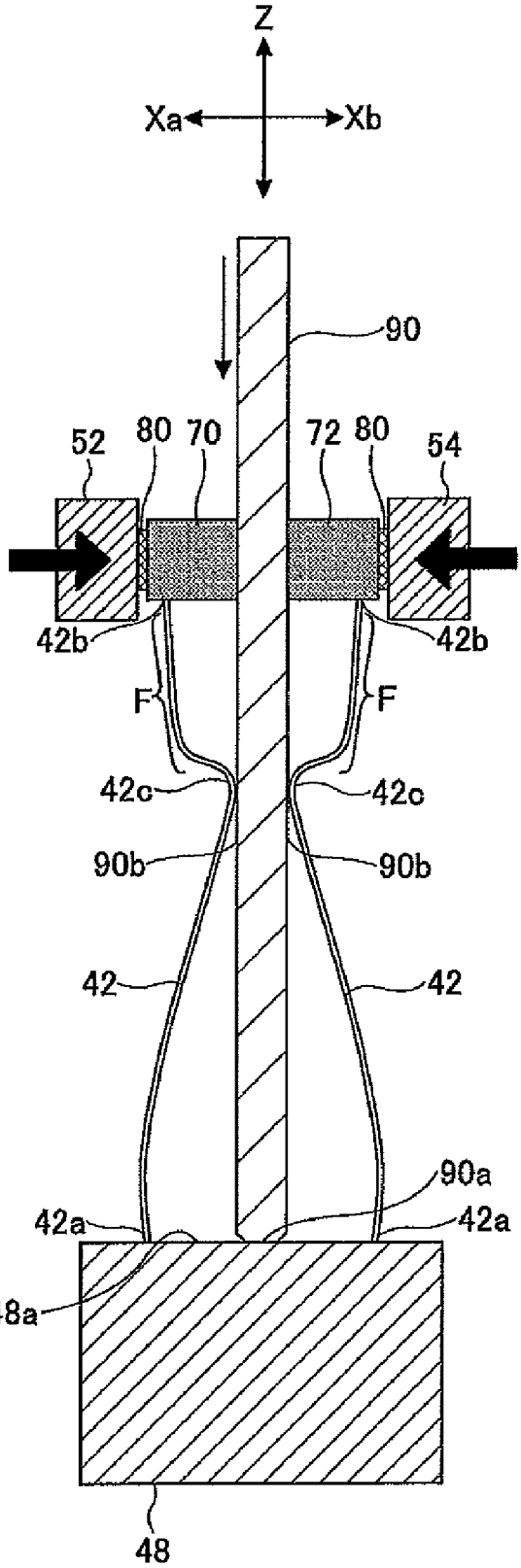
FIG. 9C is a vertical cross-sectional view for explaining a third step in a case where the plug connector 90 is inserted into the center of the insertion part 30.

FIG. 9A through FIG. 9C show basic operations of the connector 10. For the convenience of explanation, only a main part of the connector 10 is schematically shown and illustrations of other parts are omitted in FIG. 9A through FIG. 9C.

As shown in FIG. 9A, in a first step, when the plug connector 90 is inserted straightforward in a vertical direction to the center of the inserting part 30, a separating distance S1 between the plug connector 90 and the stopper part 70*c* of a left side contact holding member 70 is substantially equal to a separating distance S2 between the plug connector 90 and the stopper part 70*c* of a right side contact holding member 70 (S1≈S2).

Similarly, a separating distance S3 between the plug connector 90 and the left side contact part 42*c* is substantially equal to a separating distance S4 between the plug connector 90 and the right side contact part 42*c* (S3≈S4).

In addition, when the inserting side end part 90*a* of the plug connector 90 comes in contact with the upper surface 48*a* of the basic end part holding member 48, inserting operations of the plug connector 90 stop.

As shown in FIG. 9B, in a second step, the driving part 50 is driven in the Ya-direction so that the cam parts 52*a* and 54*a* of the driving members 52 and 54 press the elastic members 80 to an inserting part 30 side (in the Xb-direction and in the Xa-direction).

As a result of this, the contact holding members 70 and 72 having the elastic members 80 are pressed in a direction (the Xb-direction and in the Xa-direction) where the contact holding members 70 and 72 are close to each other. Because of this, in the contact member 42, since the lower part E formed between the basic end part holding member 48 and the contact part 42*c* is softer than the upper part (a spring force of the lower part E is smaller than that of the upper part F), the lower part E is elastically deformed inside.

The lower part E of the contact member 42 is an urging part configured to urge the head end part 42*b* in the Xa or Xb direction where the head end part 42*b* is separated from the plug connector 90. A contact pressure of the contact part 42*c* due to a spring force of the lower part E is relatively small. In a case where the plug connector 90 is inserted in the center of the inserting part 30, the amount of elastic deformation of the lower parts E of the contact members 42 situated at both sides of the plug connector 90 are substantially equal to each other.

The contact part 42*c*, compared to the head end part 42*b*, of the contact member 42 projects to the inserting part 30 side. Hence, the contact holding members 70 and 72 are deformed in the Xb and Xa directions and first come in contact with the non-contact parts 90*b* formed on the two surfaces of the plug connector 90. At this time, the contact holding members 70 and 72 are separated from the plug connector 90.

As shown in FIG. 9C, in a third step, the contact holding members 70 and 72 are pressed in a direction where the contact holding members 70 and 72 are close to each other. Therefore, the stopper parts 70*c* and 72*c* come in contact with the corresponding side surfaces of the plug connector 90. By this contact operation, the upper part F of the contact member 42 is elastically deformed in the pressing direction, and a spring force due to this elastic deformation acts on the contact part 42*c*.

In addition, when the elastic member 80 is compressed by the pressing operations of the cam parts 52*a* and 54*a* of the driving members 52 and 54, a contact force generated from the upper part F of the contact member 42 depending on the amount of contraction of the elastic member 80 is applied to the contact holding members 70 and 72.

Because of this, the stopper parts 70*c* and 72*c* of the contact holding members 70 and 72 are pressed with a sufficient pressure (clamp force) to corresponding side surfaces of the plug connector 90. As a result of this, the plug connector 90 is sandwiched by the contact parts 42*c* formed in the intermediate part of the contact member 42 and the contact holding members 70 and 72 holding the head end parts 42*b*.

Under this structure, the plug connector 90 during the inspection is sandwiched by a stronger clamp force so as to be prevented from being disconnected from the inserting part 30.

In this case, since the plug connector 90 is inserted in the center of the inserting part 30, the amounts of elastic deformation of the elastic members 80 and the lower part F of the contact member 42 provided at left and right side of the plug connector 90 are substantially equal to each other. In addition, the contact part 42*c* contacting the contacted part 90*b* of the plug connector 90 applies a spring force as the contact pressure due to elastic deformation of the upper part F of the contact member 42 to the plug connector 90.

In other words, a spring force obtained by the deformation amount until the contact holding members 70 and 72 come in contact with the plug connector 90 is a contact pressure to the plug connector 90. It is possible to press the contact part 42*c* to the contacted part 90*b* of the plug connector 90 so that necessary contact pressure is always maintained. In addition, since the plug connector 90 is inserted in the center of the inserting part 80, the contact pressure to left and right sides of the plug connector 90 us acted substantially equally.

Next, a case where the plug connector 90 is inserted in the inserting part 30 where the pug connector 90 is shifted is discussed with reference to FIG. 10A and FIG. 10B.

Figure 10A:
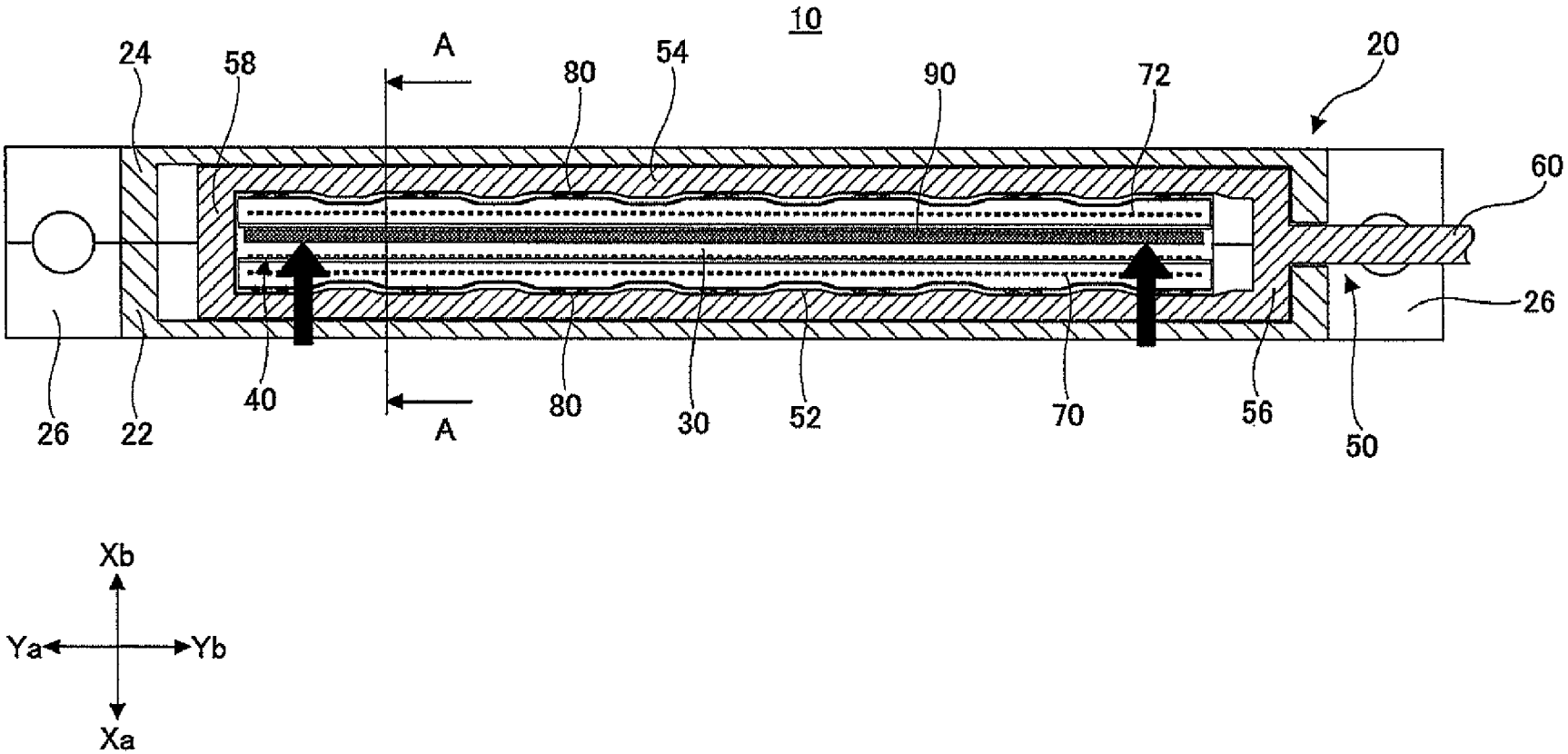
FIG. 10A is a plan view showing a case where the plug connector 90 is inserted and shifted in an Xb direction from the center of the insertion part 30.

FIG. 10A is a plan view showing a case where the plug connector 90 is inserted and is shifted in an Xb direction from the center of the insertion part 30. FIG. 10B is a plan view showing a case where the plug connector 90 is inserted and is shifted clockwise from the center of the insertion part 30.

Figure 10B:
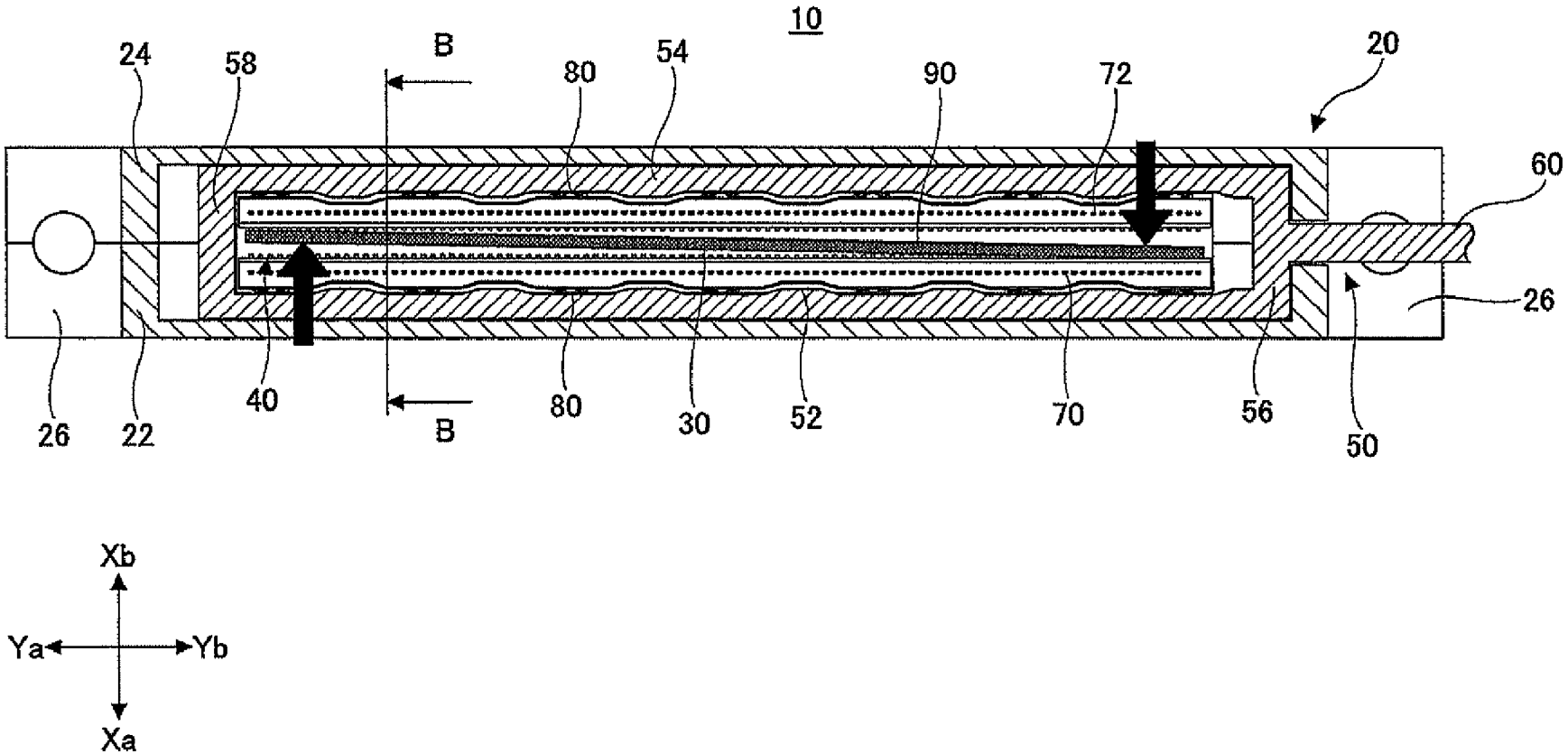
FIG. 10B is a plan view showing a case where the plug connector 90 is inserted and is shifted clockwise from the center of the insertion part 30.

The plug connector 90 is shifted, for example, in a case shown in FIG. 10A where the plug connector 90 is inserted in the inserting part 30 while the plug connector 90 is shifted in the Xb (or Xa) direction, or in a case shown in FIG. 10B where the plug connector 90 is inserted in the inserting part 30 while the plug connector 90 is inclined in the Y direction clockwise seen from an upper part (counterclockwise seen from a lower part) against the inserting part 30.

The reason why the inserting position of the plug connector 90 is shifted may be, for example, cumulative errors of dimension tolerance of each member and relative position errors in a case where a large number of the plug connectors 90 are inserted in a large number of the connectors in a body.

Next, operations of insertion of the plug connector 90 in a case where the plug connector 90 is shifted in the X-direction and inclined in the Y-direction are discussed with reference to FIG. 11A through FIG. 11C.

Figure 11A:
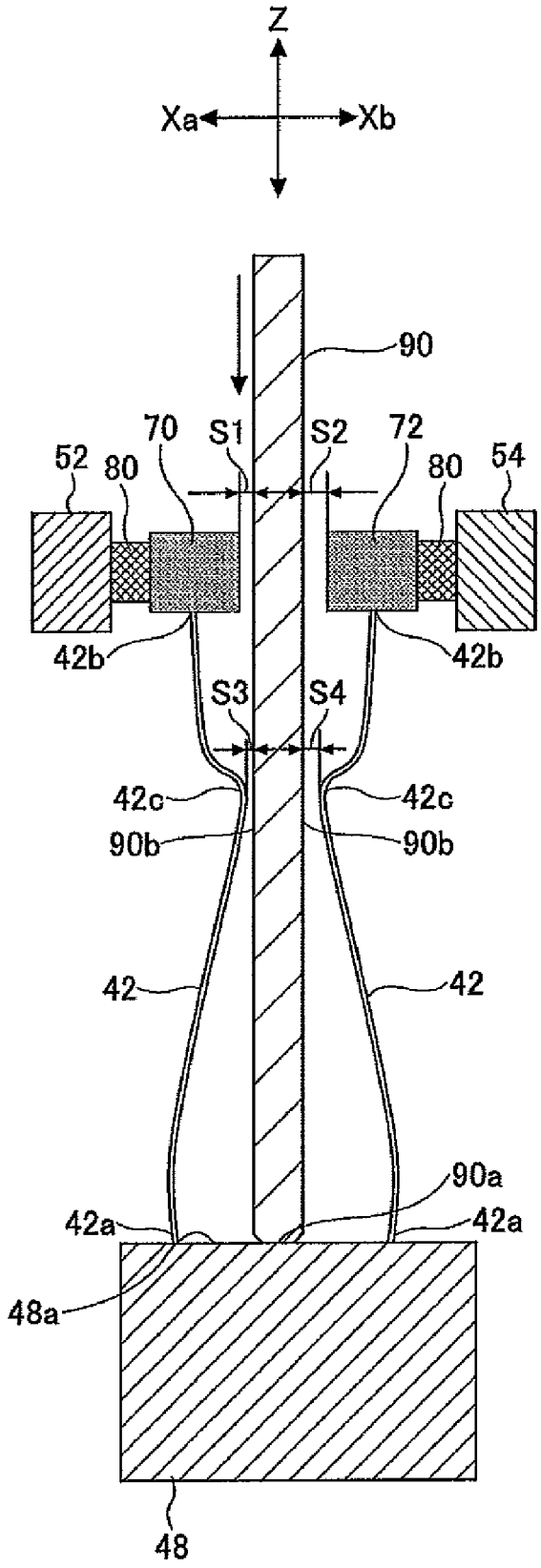
FIG. 11A is a vertical cross-sectional view for explaining a first step in a case where an insertion position of the plug connector 90 is shifted.

FIG. 11A is a vertical cross-sectional view for explaining a first step in a case where an insertion position of the plug connector 90 is shifted. FIG. 11B is a vertical cross-sectional view for explaining a second step in the case where the insertion position of the plug connector 90 is shifted. FIG. 11C is a vertical cross-sectional view for explaining a third step in the case where the insertion position of the plug connector 90 is shifted.

As shown in FIG. 11A, in a case where the plug connector 90 is inserted while the plug connector 90 is shifted from the center of the inserting part 30 in the first step, the separating length S1 between the stopper part 70*c* of the left side contact holding member 89 and the plug connector 90 becomes narrower, and the separating length S2 between the stopper part 72*c* of the right side contact holding member 70 and the plug connector 90 becomes wider (S1<S2).

Similarly, the separating length S3 between the left side contact part 42*c* and the plug connector 90 becomes narrower, and the separating length S4 between the right side contact part 42 and the plug connector 90 becomes wider (S3<S4).

Figure 11B:
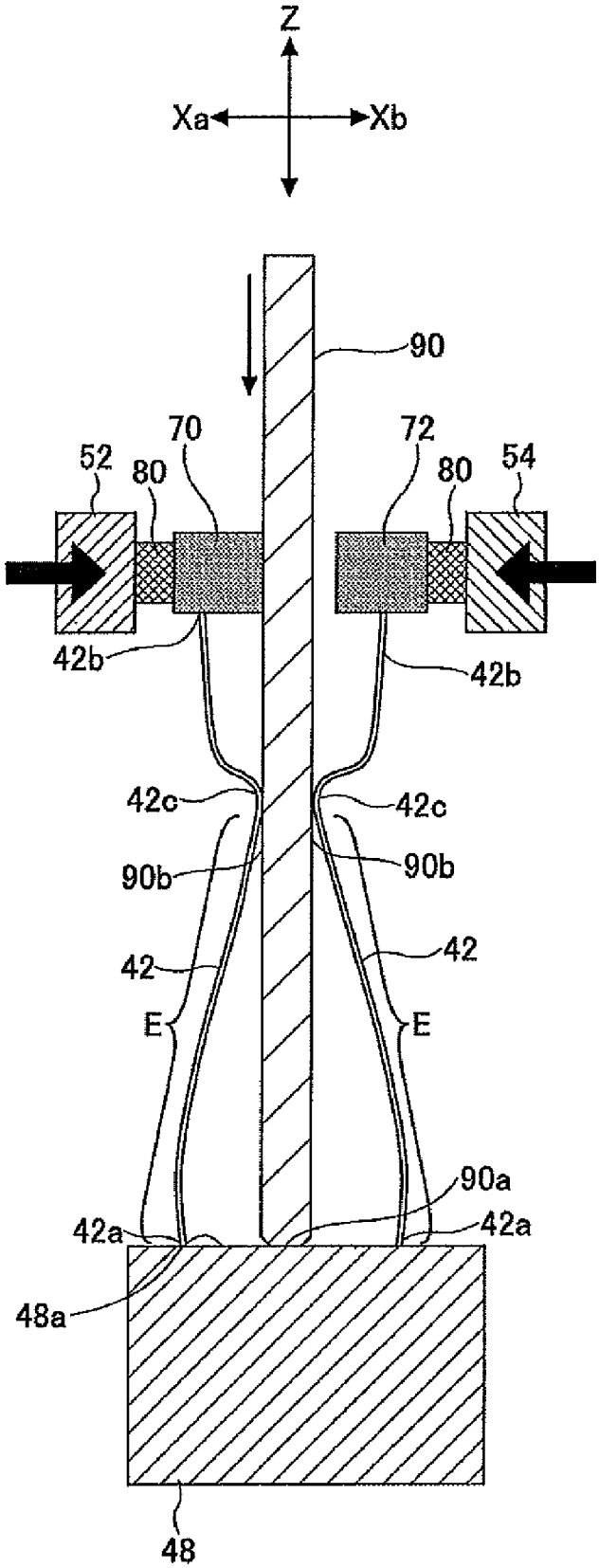
FIG. 11B is a vertical cross-sectional view for explaining a second step in the case where the insertion position of the plug connector 90 is shifted.

As shown in FIG. 11B, in the second step, the driving part 50 is driven in the Ya-direction so that the cam parts 52*a* and 54*a* of the driving members 52 and 54 press the elastic member 80 to the inserting part 30 side (in the Xb-direction or Xa-direction). Because of this, the contact holding members 70 and 72 having the elastic members 80 are pressed in the Xb-direction or the Xa-direction where the contact holding members 70 and 72 are close to each other.

As a result of this, in the contact member 42 situated at a left side where the plug connector 90 is shifted, the lower part E formed between the basic end part holding member 48 and the contact part 42*c* is elastically deformed, so that the contact part 42*c* comes in contact with the contacted part 90*b* of a left side surface of the plug connector 90. Similarly, the stopper part 70*c* of the contact holding member 70 situated at a left side where the plug connector 90 is shifted comes in contact with the left side surface of the plug connector 90.

At this time, a right side surface of the plug connector 90 situated at a side 180 degrees opposite to the shifting direction comes in contact with the right side contact part 42*c* but not the contact holding member 72.

Figure 11C:
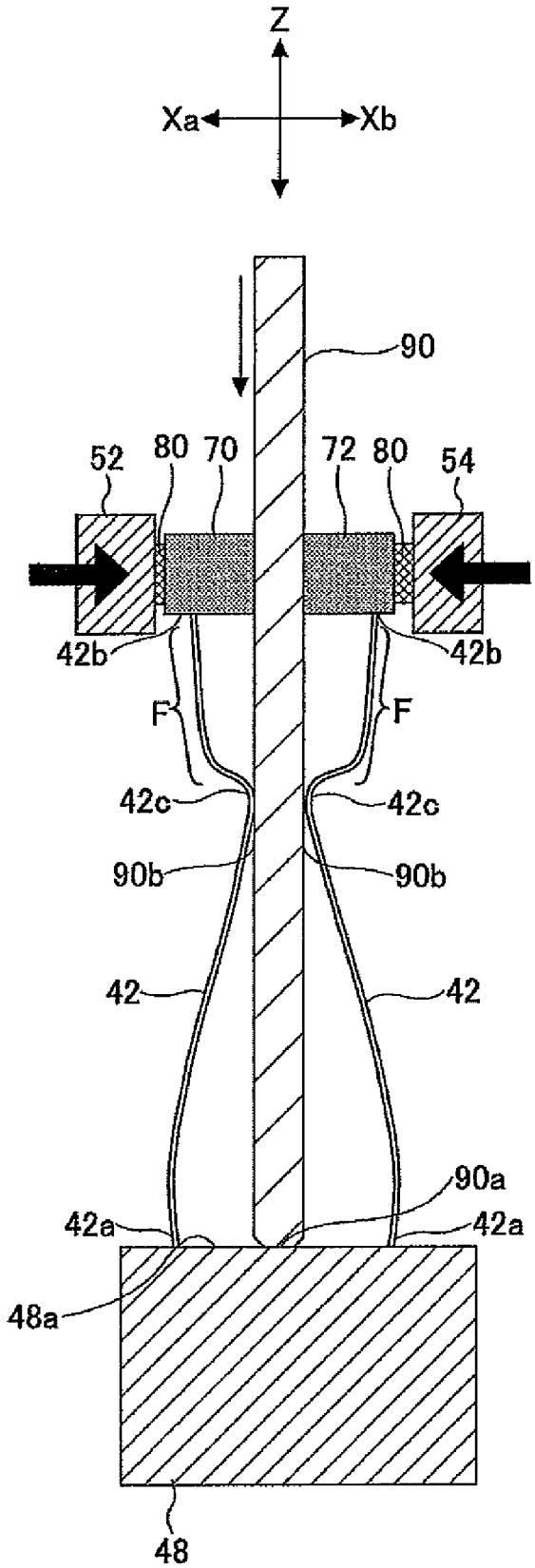
FIG. 11C is a vertical cross-sectional view for explaining a third step in the case where the insertion position of the plug connector 90 is shifted.

As shown in FIG. 11C, in a third step, the contact holding members 70 and 72 having the elastic members 80 are further pressed in the Xb-direction or the Xa-direction where the contact holding members 70 and 72 are made to be further close to each other. Hence, insides of the contact holding members 70 and 72 (the stopper parts 70*c* and 72*c*) come in contact with the corresponding side surfaces of the plug connector 90. By this operation, the upper part F of the contact member 42 is elastically deformed in the pressing direction so that the spring force due to the elastic deformation is applied to the contact part 42*c*.

At this time, the amount of elastic deformation of the left side contact member 42 is small and the amount of elastic deformation of the right side contact member 42 is large.

In addition, when the elastic member 80 is compressed by pressing operations of the cam parts 52*a* and 54*a* of the driving members 52 and 54, the amount of elastic deformation of the left side elastic member 80 becomes large and the amount of elastic deformation of the right side elastic member 80 becomes small so that pressing force applying to the left and right side surfaces of the plug connector 90 becomes balanced.

As a result of this, the plug connector 90 is sandwiched by the contact part 42*c* formed in the intermediate part of the contact member 42 and the contact holding members 70 and 72 configured to the head end parts 42*b*. Because of this, the plug connector 90 being inspected is sandwiched by strong claming forces and is prevented from being disconnected from the inserting part 30.

In this case, because the plug connector 90 is inserted in a position shifted from the center of the inserting part 30, the amount of the elastic deformation of the left side elastic member 80 is increased based on the small amount of the elastic deformation of the contact member 42 provided at the left side (shift side) of the plug connector 90. In addition, the amount of the elastic deformation of the right side elastic member 80 is decreased based on the large amount of the elastic deformation of the contact member 42 provided at the right side (a side 180 opposite to the shift side) of the plug connector 90.

Thus, the contact part 42*c* in a case where the plug connecter 90 is inserted while the plug connecter 90 is shifted can act as a contact force generated from the upper part F of the contact member 42 depending on the amount of contraction of the elastic member 80 as contact pressure on the plug connector 90.

In other words, the contact pressure on the plug connector 90 becomes a certain pressure by the amount of deformation until the contact holding members 70 and 72 come in contact with the corresponding side surfaces of the plug connector 90. While a necessary contact pressure is always secured, it is possible to contact the contact part 42*c* with the contacted part 90*b* of the plug connector 90.

In addition, even if the plug connector 90 is inserted so that the plug connector 90 is shifted in the X-direction, the contact pressures applied to left and right sides of the plug connector 90 act substantially equally.

Next, modified examples are discussed with reference to FIG. 12A through FIG. 12C.

Figure 12A:
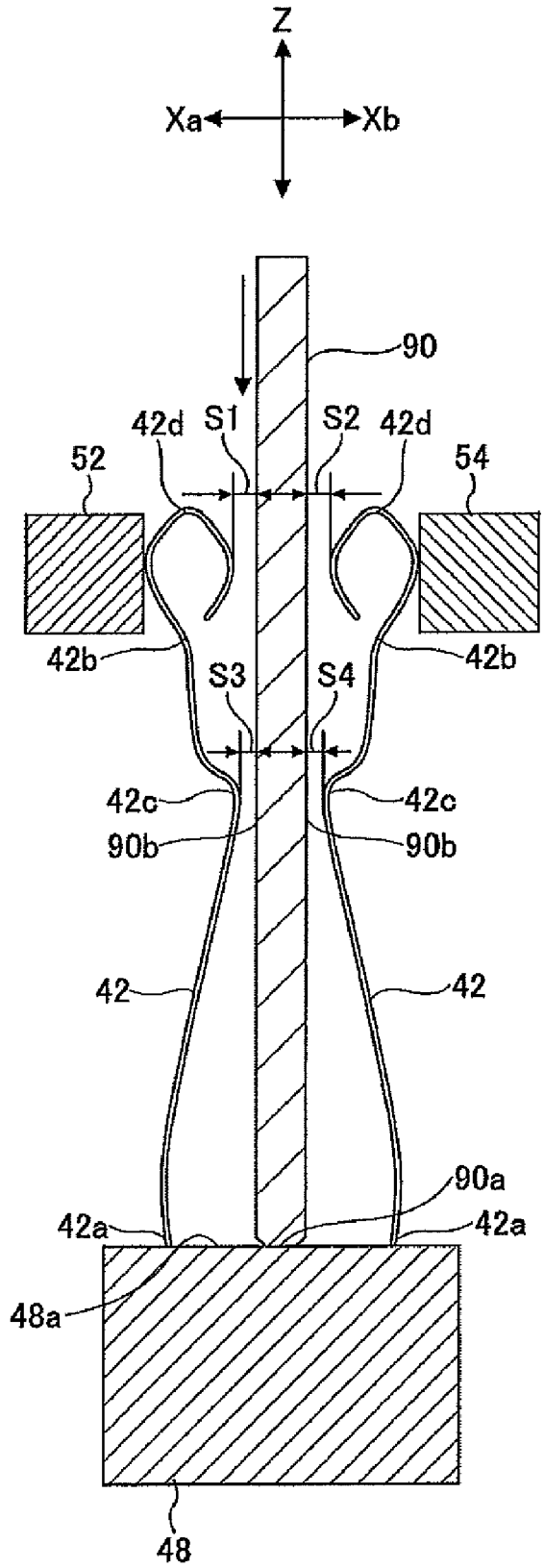
FIG. 12A is a vertical cross-sectional view for explaining a first step of a modified example.

Here, FIG. 12A is a vertical cross-sectional view for explaining a second step of a modified example. FIG. 12B is a vertical cross-sectional view for explaining a first step of a modified example. FIG. 12C is a vertical cross-sectional view for explaining a third step of a modified example. In FIG. 12A through FIG. 12C, parts that are the same as the parts discussed in the first embodiment of the present invention are given the same reference numerals, and explanation thereof is omitted.

In the modified example, as shown in FIG. 12A, the elastic member 80 and the contact holding members 70 and 72 are not used. In other words, upper contact parts 42*d* bent in rhomboidal shapes are formed at the head end parts 42*d* of the contact members 42. Furthermore, the cam parts 52*a* and 54*a* of the driving members 52 and 54 configured to the upper part contact parts 42*d* are made of insulation resin material. Under this structure, even if the cam parts 52*a* and 54*a* directly press the upper part contact parts 42*d* of the contact members 42, the contact members 42 are not contacted.

In addition, since the upper part contact parts 42*d* bent n rhomboidal shapes can be elastically deformed based on the pressing force in the X-direction, a spring force corresponding to the shift amount of the plug connector 90 instead of the elastic member 80 is generated so that the contact pressure on the plug connector 90 can be maintained.

Figure 12B:
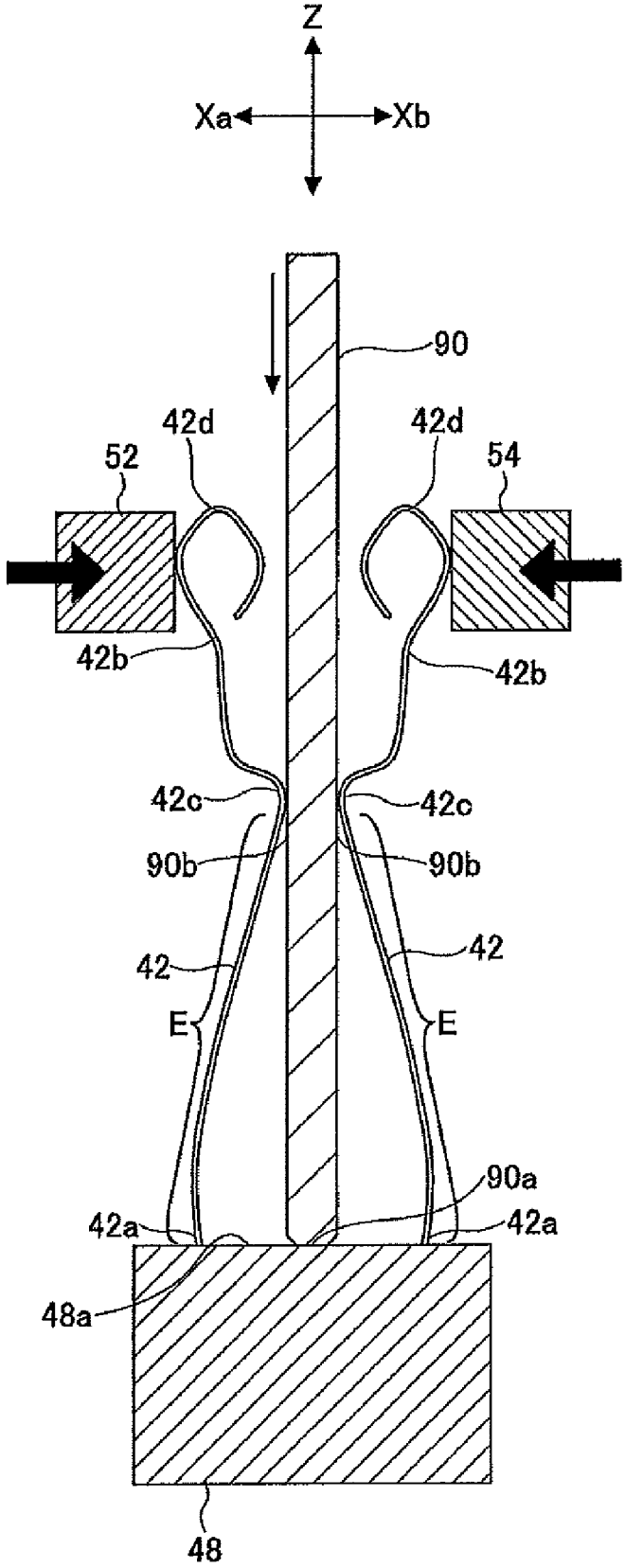
FIG. 12B is a vertical cross-sectional view for explaining a first step of a modified example.

As shown in FIG. 12B, in the second step, the driving part 50 is driven in the Ya-direction so that the cam parts 52*a* and 54*a* of the driving members 52 and 54 press the upper part contact parts 42*d* of the contact members 42 to the inserting part 30 side (in the Xb and Xa directions). As a result of this, in the contact member 42, since the lower part E formed between the basic end holding member 48 and the contact part 42*c* is softer than the upper part F (the spring force of the lower part E is smaller than that of the upper part F), the lower part F is elastically deformed inwardly.

In a case where the plug connector 90 is inserted in the center of the inserting part 30, the contact parts 42*c* of the intermediate parts of the contact members 42 provided at left and right sides of the plug connector 90 come in contact with the contacted part 90*b* formed on both side surfaces of the plug connector 90. At this time, the upper part contact parts 42*d* are separated from the plug connector 90.

Figure 12C:
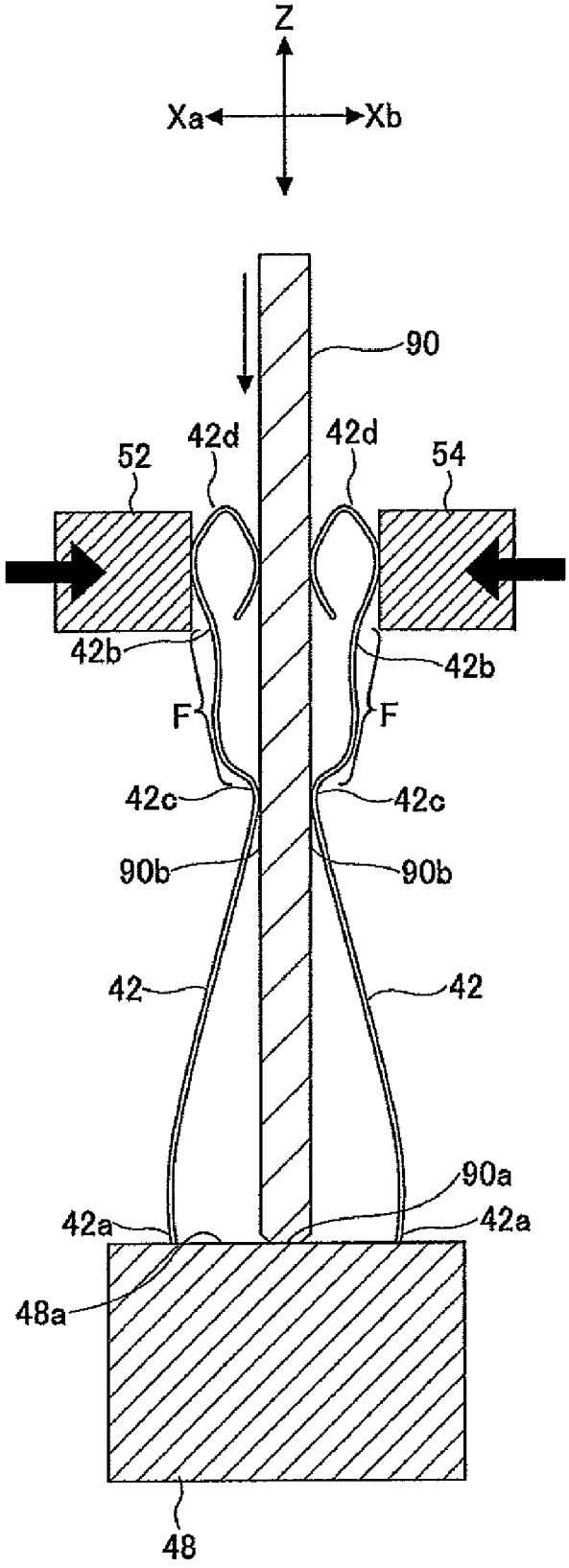
FIG. 12C is a vertical cross-sectional view for explaining a third step of a modified example.

As shown in FIG. 12C, in the third step, the upper part contact parts 42*d* of the contact member 42 are further pressed in a direction where the upper part contact parts 42*d* of the contact member 42 are close to each other, insides of the upper part contact parts 42*d* come in contact with the corresponding side surfaces of the plug connector 90. By this contact operation, the upper part F of the contact member 42 is elastically deformed in the pressing direction so that a spring force due to this elastic deformation acts on the contact part 42*c*. In addition, the upper contact parts 42*d* are compressed by pressing operations of the cam parts 52*a* and 54*a* of the driving members 52 and 54.

Because of this, the upper part contact parts 42*d* are pressed to corresponding side surfaces of the plug connector 90 with a sufficient designated pressure (clamp force). As a result of this, the plug connector 90 is sandwiched by the contact parts 42*c* formed in the intermediate part of the contact member 42 and the upper part contact parts 42*d* provided at the head end part 42*b*.

In this case, since the plug connector 90*b* is inserted in the center of the inserting part 30, the amounts of elastic deformation of the lower parts F and the upper part contact parts 42*d* of the contact members 42 provided at left and right side of the plug connector 90 are substantially equal to each other.

In addition, the contact parts 42*c* coming in contact with the contacted part 90*b* of the plug connector 90 can exert a spring force based on elastic deformation of the upper part F of the contact member 42 as a contact pressure on the plug connector 90. In other words, the contact pressure on the plug connector 90 becomes a designated pressure due to the amount of deformation until the upper part contact parts 42*d* come in contact with the plug connector 90. It is possible to press and contact the contact parts 42*c* to the contacted part 90*b* of the plug connector 90 so that necessary contact pressure is always secured. Furthermore, since the plug connector 90 is inserted in the center of the inserting part 30, the contact pressure on right and left sides of the plug connector 90 are substantially equal.

In addition, if the plug connector 90 is inserted in the inserting part 30 and is shifted in the X-direction, by the pressing operations of the cam parts 52*a* and 54*a* of the driving members 52 and 54, the shift side upper part contact part 42*d* is compressed greatly.

Because of this, the amount of elastic deformation of the shift side upper part contact part 42*d* becomes large and the amount of elastic deformation of the opposite side upper part contact part 42*d* becomes small so that pressing forces applied to the left and right side surfaces of the plug connector 90 become balanced. As a result of this, the plug connector 90 is sandwiched by the contact parts 42*c* of the contact member 42 and the upper part contact part 42*d* provided at the head end parts 42*b*. The position of the contact parts 42*c* is not limited to the position of this example but may be an optional position.

Since the plug connector 90 is inserted in a position shifted from the center of the inserting part 30 of the plug connector 90, the amount of the elastic deformation of the upper part contact part 42*d* provided at the shift side of the plug connector 90 is increased based on the amount of the elastic deformation of the contact member 42 provided at the shift side of the plug connector 90.

In addition, based on the large amount of the elastic deformation of the contact member 42 provided at a side 180 degrees opposite to the shift side of the plug connector 90, the amount of the elastic deformation of the upper part contact part 42*d* provided at the opposite side is decreased.

Thus, if the plug connector 90 is inserted and is shifted, the shift side contact part 42*c* can apply a resultant force of the spring force due to elastic deformation of the upper part F of the contact member 42 and the spring force of the upper part contact part 42*d* as the contact pressure on the plug connector 90.

In other words, the contact pressure on the plug connector 90 becomes a designated pressure due to the amount of deformation until the upper part contact parts 42*d* come in contact with corresponding surfaces of the plug connector 90. It is possible to press and contact the contact parts 42*c* to the contacted parts 90*b* of the plug connector 90 so that necessary contact pressure is always secured. Furthermore, even if the plug connector 90 is inserted and is shifted in the X-direction, the contact pressures to right and left sides of the plug connector 90 are applied substantially equally.

Second Embodiment

Figure 13A:
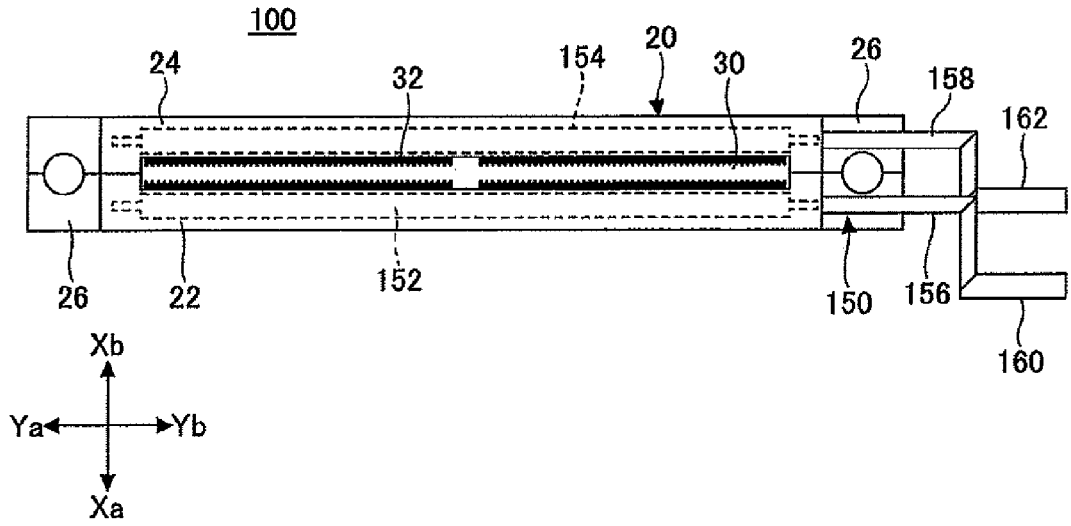
FIG. 13A is a plan view of a connector of a second embodiment of the present invention.
Figure 13B:
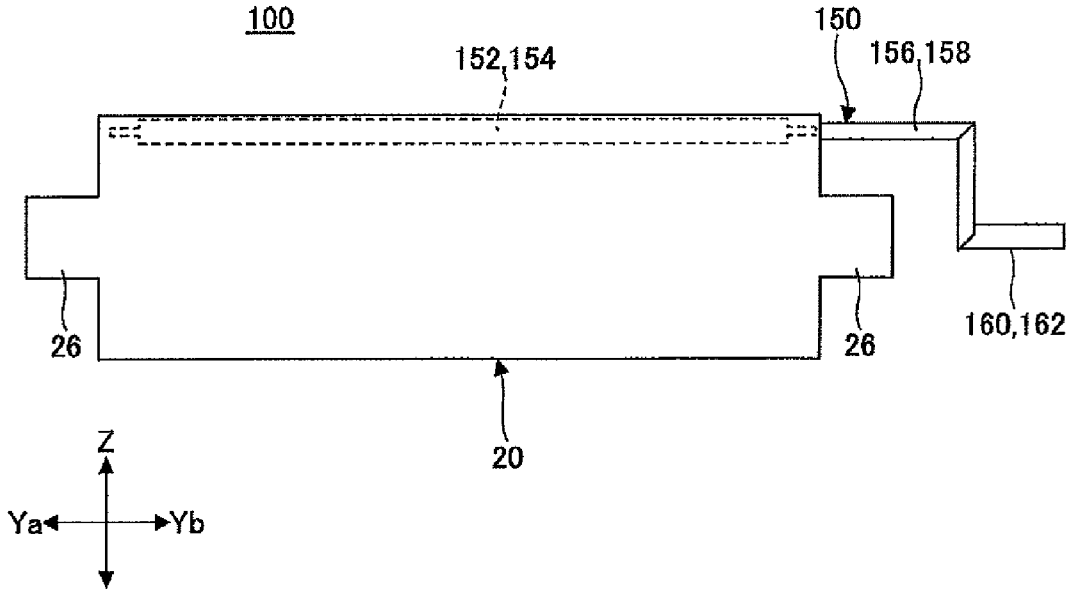
FIG. 13B is a front view of the connector of a second embodiment of the present invention.
Figure 13C:
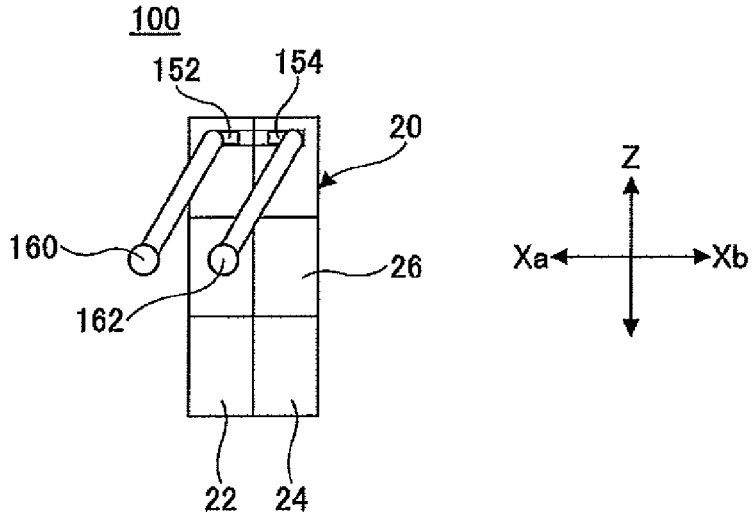
FIG. 13C is a side view of the connector of a second embodiment of the present invention.

FIG. 13A is a plan view of a connector of a second embodiment of the present invention. FIG. 13B is a front view of the connector of a second embodiment of the present invention. FIG. 13C is a side view of the connector of a second embodiment of the present invention. In FIG. 13A through FIG. 13C, parts that are the same as the parts discussed in the first embodiment of the present invention are given the same reference numerals, and explanation thereof is omitted.

As shown in FIG. 13A through FIG. 13C, a connector 100 of the second embodiment of the present invention includes the housing 20, the inserting part 30, the contact part 40, and a driving part 150. The inserting part 30 is formed inside the housing 20. The contact part 40 is provided at both sides of the inserting part 30. The driving part 150 is configured to drive the contact part 40.

The driving part 150 includes a first driving member 152 and a second driving member 154. The first driving member 152 extends in the Y-direction outside the first contact member line 44. The second driving member 154 extends in the Y-direction outside the second contact member line 46. The first driving member 152 and the second driving member 154 are supported so as to rotate inside the housing 20 and one end 156 or 158 projects from a side surface of the housing 20 in the Y-direction. In addition, crank driving shafts 160 and 162 are connected to ends 156 and 158.

The crank driving shafts 160 and 162 are connected to a driving part provided outside the housing 20. This driving part transfers the driving force in the X-direction to end parts of the crank driving shafts 160 and 162 so as to rotate the driving members 152 and 154 of the driving part 150 90 degrees.

Figure 14A:
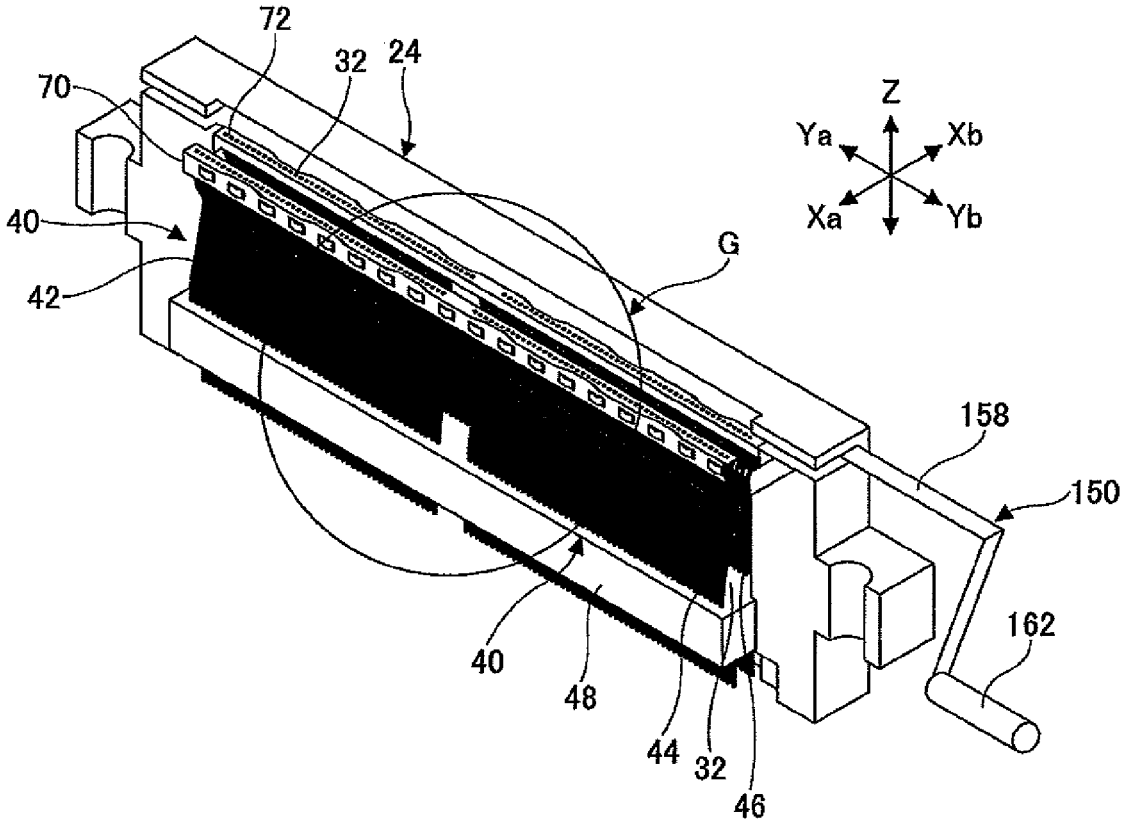
FIG. 14A is a perspective view of the connector shown in FIG. 13 where a cover member is removed.
Figure 14B:
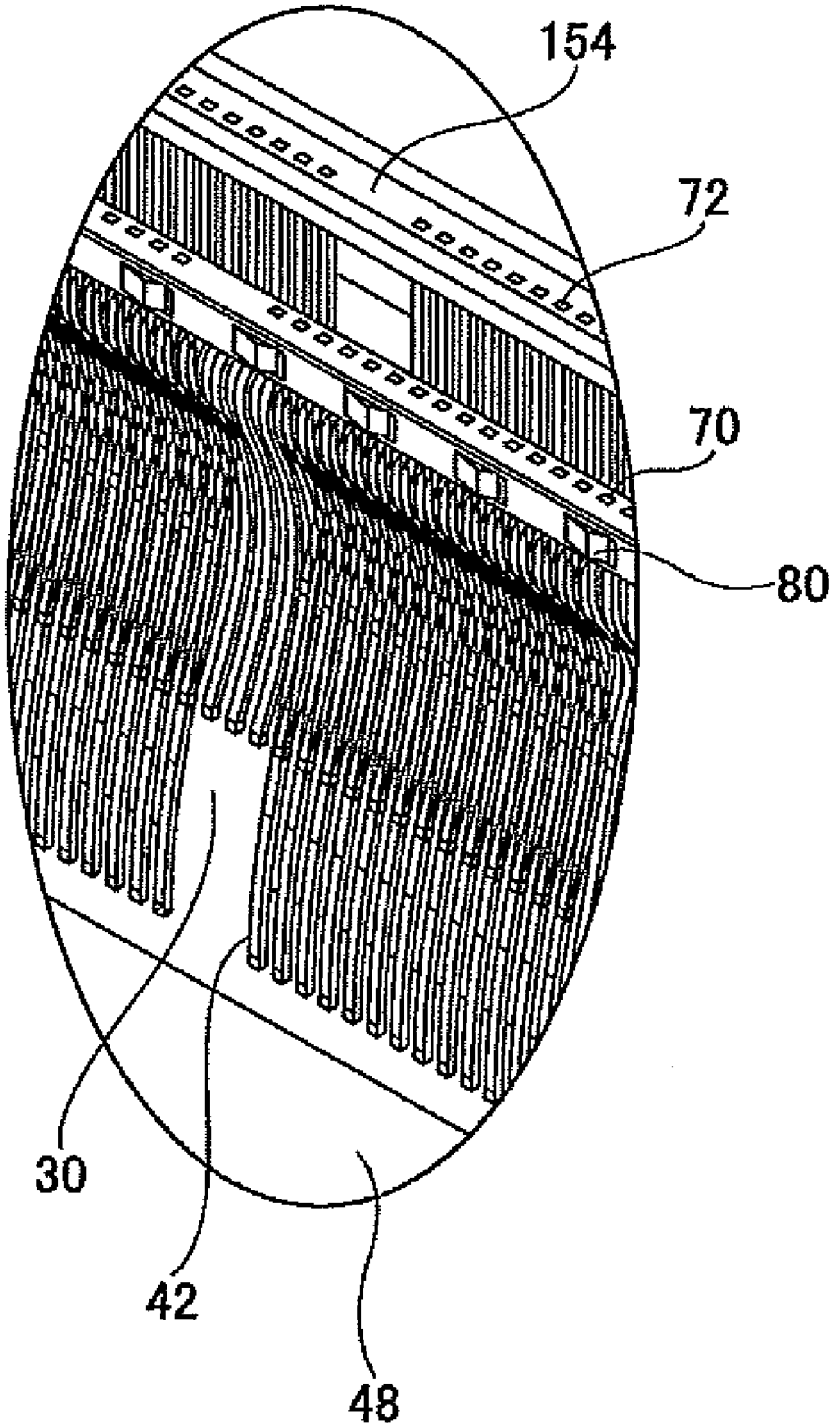
FIG. 14B is an expanded perspective view of a portion G shown in FIG. 14A.

FIG. 14A is a perspective view of the connector shown in FIG. 13 where a cover member is removed. FIG. 14B is an expanded perspective view of a portion G shown in FIG. 14A.

As shown in FIG. 14A and FIG. 14B, the contact part 40 of the second embodiment has the substantially same structure as the contact part 40 of the first embodiment. The contact part 40 of the second embodiment includes the first contact member line 44 and the second contact member line 46 where a large number of the contact members 42 are arranged. In the first contact member line 44 and the second contact member line 46, the basic end parts 42*a* which are lower parts of the contact members 42 are held by the basic end parts holding members 48.

The elastic members 80 which are plate springs extending in the Y-direction are provided on the external side surfaces of the first contact holding member 70 and the second contact holding member 72.

Top parts 80*a* formed in the intermediate part in the Y-direction of the elastic members 80 project so as to come in contact with the driving members 152 and 154.

Figure 15A:
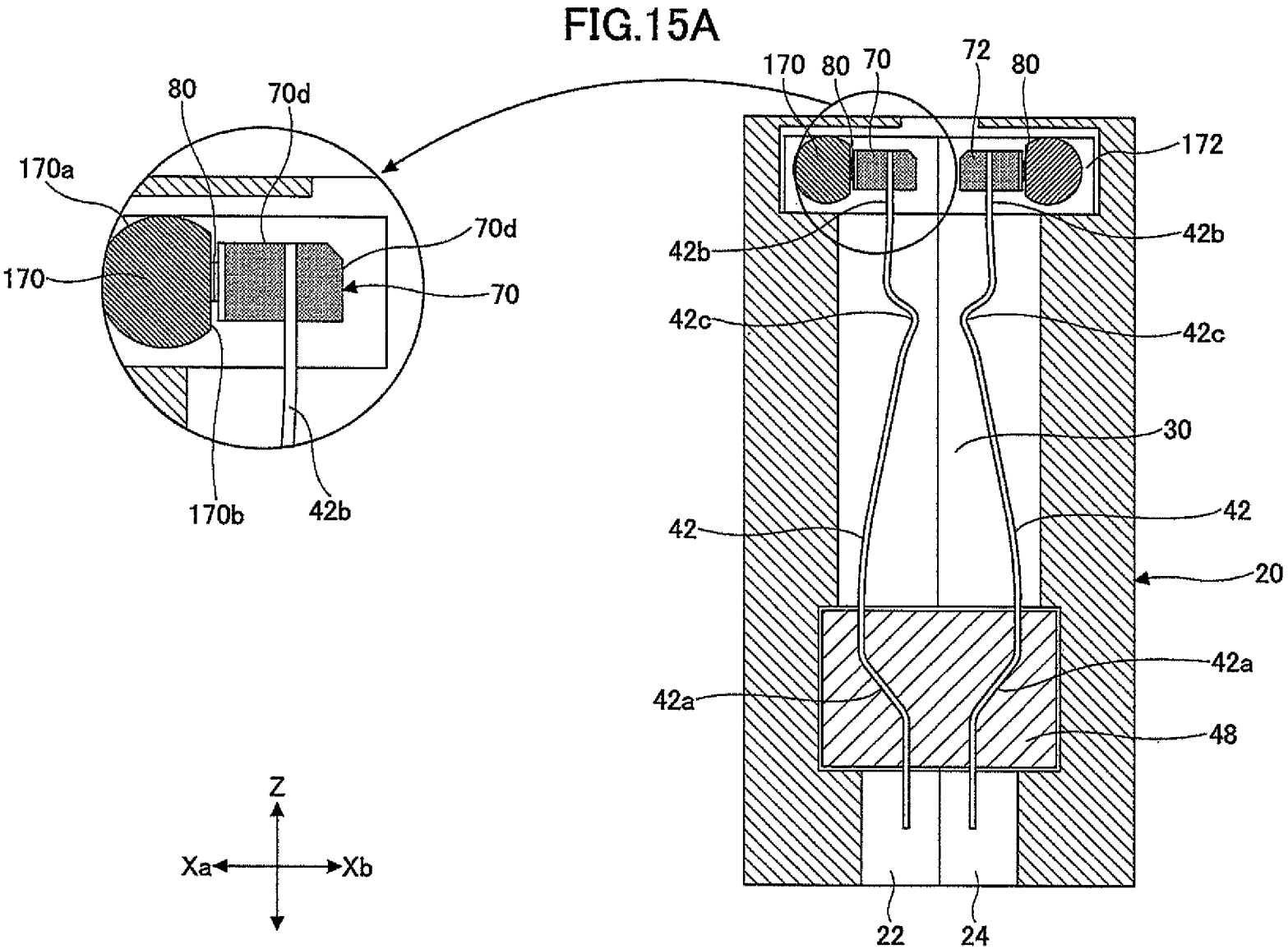
FIG. 15A is a rotated vertical cross-sectional view of the connector before the plug connector 90 of the second embodiment of the present invention is inserted.

FIG. 15A is a vertical cross-sectional view of the connector 100 before the plug connector 90 of the second embodiment of the present invention is inserted.

As shown in FIG. 15A, both ends of the driving members 152 and 154 are supported so as to be rotated by a bearing formed inside the housing 20. Cam parts 170 and 172 configured to press the elastic members 80 are provided on the external circumference. The cam parts 170 and 172 have D-shaped cross-sectional configurations formed by chamfering the external circumferences and include circular arc parts 170*a* and 172*a* and chamfered parts 170*b* and 172*b*.

Before the plug connector 90 is inserted, the chamfered parts 170*b* and 172*b* of the cam parts 170 and 172 come in contact with the elastic members 80 and each elastic member 80 is not pressed to the inserting part 30 side. Because of this, a separating length between the contact parts 42*c* of the contact member 42 provided at both sides of the inserting part 30 is longer than the thickness of the plug connector 90.

Accordingly, the plug connector 90 is inserted in the inserting part 30 without the side surfaces of the plug connector 90 coming in contact with the contact parts 42*c* of the contact member 42.

Figure 15B:
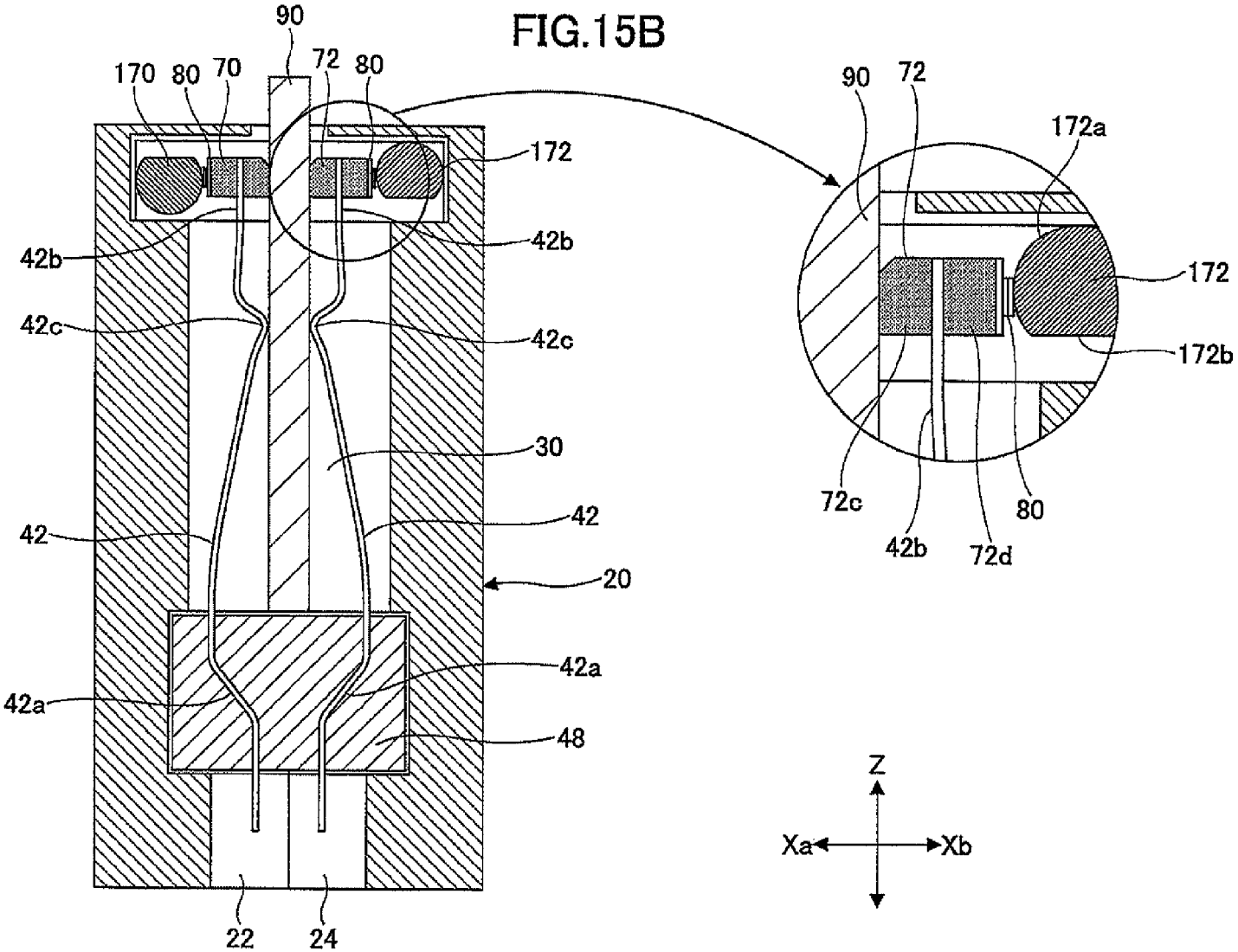
FIG. 15B is a rotated vertical cross-sectional view of the connector after the plug connector 90 of the second embodiment of the present invention is inserted.

FIG. 15B is a vertical cross-sectional view of the connector 100 after the plug connector 90 of the second embodiment of the present invention is inserted.

As shown in FIG. 15B, when the plug connector 90 is inserted in the inserting part 30, the crank driving shafts 160 and 162 are driven in the X-direction so that the cam parts 170 and 172 of the driving members 152 and 154 are rotated 90 degrees. As a result of this, in the cam parts 170 and 172, the circular arc parts 170*a* and 172*a* press the top parts 80*a* of the elastic members 80 to the plug connector 90 side.

Since the contact holding members 70 and 72 are pressed by the elastic members 80 in directions where the contact holding members 70 and 72 are closed to each other, in this embodiment as well as the first embodiment, the stopper parts 70*c* and 72*c* come in contact with the corresponding side surfaces of the plug connector 90. By this contact operation, the upper part F of the contact member 42 is elastically deformed in a pressing direction so that the spring force due to this elastic deformation transmits contact pressure of the contact part 42*c*. Furthermore, the elastic members 80 are compressed by rotational operations of the cam parts 170 and 172 of the driving members 152 and 154 so that the spring forces of the elastic members 80 are applied to the contact holding members 70 and 72.

Because of this, the stopper parts 70*c* and 72*c* of the contact holding members 70 and 72 are pressed to the corresponding side surfaces of the plug connector 90 with a sufficient designated pressure (clamping force). As a result of this, the plug connector 90 is sandwiched by the contact parts 42*c* formed in the intermediate part of the contact member 42 and the contact holding members 70 and 72 configured at the head end parts 42*b*. Thus, the plug connector 90 being inspected is sandwiched by strong clamping forces and is prevented from separating from the inserting part 30.

Accordingly, the contact parts 42*c* contacting the contacted parts 90*b* of the plug connector 90 can apply a spring force due to elastic deformation of the upper part F of the contact member 42 as contact pressure on the plug connector 90. In addition, since the plug connector 90 is inserted in the center of the inserting part 80, the contact pressures to left and right sides of the plug connector 90 act substantially equally.

In addition, if the plug connector 90 is inserted in the inserting part 30 and is shifted in the X-direction by the pressing due to rotational operations of the cam parts 170 and 172 of the driving members 152 and 154, the shifted side elastic member 80 is compressed greatly.

Because of this, the amount of elastic deformation of the shifted side elastic member 80 becomes large and the amount of elastic deformation of the opposite side elastic member 80 becomes small so that pressing forces applied to the left and right side surfaces of the plug connector 90 becomes balanced. As a result of this, the plug connector 90 is sandwiched by the contact parts 42*c* of the contact members 42 and the contact holding members 70 and 72 provided at the head end parts 42*b*.

In this case, since the plug connector 90 is inserted in a position shifted from the center of the inserting part 30, the amount of the elastic deformation of the elastic member 80 provided at the shift side of the plug connector 90 is increased based on the amount of the elastic deformation of the contact member 42 provided at the shift side of the plug connector 90.

In addition, based on the large amount of the elastic deformation of the contact member 42 provided at a side 180 degrees opposite to the shift side of the plug connector 90, the amount of the elastic deformation of the elastic member 80 provided at the opposite side is decreased.

Thus, if the plug connector 90 is inserted and is shifted, the shift side contact part 42*c* can apply a contact force generated from the upper part F of the contact member 42 depending on the amount of contraction of the elastic member 80 applying the contact pressure on the plug connector 90.

In other words, the contact pressure on the plug connector 90 becomes a designated pressure due to the amount of deformation until the contact holding members 70 and 72 come in contact with corresponding surfaces the plug connector 90. It is possible to press and contact the contact parts 42*c* to the contacted part 90*b* of the plug connector 90 so that necessary contact pressure is always secured. Furthermore, even if the plug connector 90 is inserted and is shifted in the X-direction, the contact pressures to right and left sides of the plug connector 90 are applied substantially equally.

Although the invention has been described with respect to specific embodiments for a complete and clear disclosure, the appended claims are not to be thus limited but are to be construed as embodying all modifications and alternative constructions that may occur to one skilled in the art that fairly fall within the basic teachings herein set forth.

For example, the connector device provided in the inspection apparatus configured to electrically inspect boards is discussed in the above-mentioned embodiments of the present invention. However, the present invention is not limited to this connector. The present invention may be applied to a connector provided in other apparatuses.

This patent application is based on Japanese Priority Patent Application No. 2008-58124 filed on Mar. 7, 2008, the entire contents of which are hereby incorporated herein by reference.

What is claimed is:

1. A connector, comprising:

an inserting part where a plug connector is inserted;

a contact member provided at a side of the inserting part, the contact member being where a basic end part is fixed; and a driving part configured to drive the contact member to a position where the contact member comes in contact with a contacted part of the plug connector inserted in the inserting part;

wherein a contact part is formed between a head end part and the basic end part of the contact member, the contact part contacting the contacted part of the plug connector;

the driving part includes a driving member configured to press the head end part of the contact member to the plug connector side;

the driving member is deformed so that the contact part of the contact member comes in contact with the contacted part of the plug connector; and the driving member deforms the head end part of the contact member to the plug connector side so that the head end part of the contact member comes in contact with the plug connector.

2. The connector as claimed in claim 1, wherein the contact member is provided so that the head end part can be deformed to the plug connector side; and the contact part is curved so that a top of the curve is closest to the plug connector.

3. The connector as claimed in claim 1, wherein a connector holding member is formed at a head end part of the contact member;

the driving member includes a cam part configured to deform the head end part to the plug connector side; and by operations of the cam part, the contact part of the contact member comes in contact with the contacted part of the plug connector, and the contact holding member comes in contact with the plug connector.

4. The connector as claimed in claim 1, wherein the connector holding member holds the head end parts of plural contact members and is made of an insulation material.

5. The connector as claimed in claim 1, wherein an elastic member is provided between the driving member and the contact holding member; and after the contact holding member comes in contact with the plug connector due to deformation of the driving member, the elastic member is elastically deformed.

6. The connector as claimed in claim 1, wherein a pair of the connector holding members is provided, and one of the connector holding members is provided at one side of the inserting part and another of the connector holding members is provided at another side of the inserting part;

the one of the connector holding members holds a head end part of the contact member provided at the one side of the inserting part; and the other of the connector holding members holds a head end part of the contact member provided at the other side of the inserting part.

7. The connector as claimed in claim 3, wherein the connector holding member includes a stopper part configured to come in contact with the plug connector; and the cam part of the driving member deforms the connector holding member to the plug connector side and deforms the stopper part so that the stopper part comes in contact with the plug connector.

8. The connector as claimed in claim 3, wherein the driving member is provided outside a pair of the connector holding member; and the driving member performs sliding operations along a side surface of the plug connector so that the pair of the connector holding members is deformed to the plug connector side.

9. The connector as claimed in claim 3, wherein the driving member deforms the pair of the connector holding members to the plug connector side by a rotational operation.

10. A connecting method of a connector, the connector including an inserting part where a plug connector is inserted;

a contact member provided at a side of the inserting part, the contact member being where a basic end part is fixed; and a driving part configured to drive the contact member to a position where the contact member comes in contact with a contacted part of the plug connector inserted in the inserting part;

the connecting method of the connector comprising the steps of:

causing a contact part of the contact member to contact a contacted part of the plug connector by pressing a head end part of the contact member to a side of the plug connector inserted in the inserting part by a driving member of the driving part;

causing a head end part of the contact member to contact the plug connector by the driving of the driving member; and elastically deforming the elastic member due to deformation of the driving member when the head end part of the contact member comes in contact with the plug connector.

11. A connecting method of a connector, the connector including an inserting part where a plug connector is inserted;

a contact member provided at a side of the inserting part, the contact member being where a basic end part is fixed; and a driving part configured to drive the contact member to a position where the contact member comes in contact with a contacted part of the plug connector inserted in the inserting part;

the connecting method of the connector comprising the steps of:

causing a contact part of the contact member to contact a contacted part of the plug connector by pressing a connector holding member provided at a head end part of the contact member to a side of the plug connector inserted in the inserting part by a driving member of the driving part;

causing the connector holding member contact to the plug connector based on pressing, by the driving member, the head end part of the contact member to the side of the plug connector; and elastically deforming the elastic member due to deformation of the driving member when the contact holding member comes in contact with the plug connector.

* * * * *